US008308158B2

(12) United States Patent
Hirota

(10) Patent No.: US 8,308,158 B2
(45) Date of Patent: Nov. 13, 2012

(54) SHEET CONVEYING APPARATUS AND IMAGE FORMING APPARATUS

(75) Inventor: Kenichi Hirota, Joso (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/286,469

(22) Filed: Nov. 1, 2011

(65) Prior Publication Data

US 2012/0112405 A1 May 10, 2012

(30) Foreign Application Priority Data

Nov. 10, 2010 (JP) ..... 2010-251407

(51) Int. Cl.
*B65H 7/02* (2006.01)

(52) U.S. Cl. ..... 271/227

(58) Field of Classification Search ..... 271/227, 271/228; 399/394, 395
See application file for complete search history.

(56) References Cited

U.S. PATENT DOCUMENTS

| | | | | |
|---|---|---|---|---|
| 5,156,391 | A * | 10/1992 | Roller | 271/227 |
| 7,607,660 | B2 | 10/2009 | Inoue | |
| 2008/0006992 | A1 | 1/2008 | Inoue | |
| 2008/0012215 | A1 * | 1/2008 | Elliot | 271/228 |
| 2011/0156345 | A1 * | 6/2011 | deJong et al. | 271/228 |

* cited by examiner

*Primary Examiner* — David H Bollinger
(74) *Attorney, Agent, or Firm* — Fitzpatrick, Cella, Harper & Scinto

(57) ABSTRACT

A registration portion which conveys a sheet toward an image forming portion forming an image on the sheet includes a controlling portion which regulates a sheet skew feeding correction amount by the skew feeding correcting portion based on the sheet right angle degree detected by the end detection sensor. The controlling portion automatically calculates, from the sheet right angle degree detected by the end detection sensor, a skew feeding regulation amount used for making any one of the two sides, forming the corner of the sheet, parallel to the image and corrects the skew feeding of the sheet by the skew feeding correcting portion with the use of the skew feeding regulation amount so that any one of the two sides forming the corner of the sheet is parallel to the image.

9 Claims, 19 Drawing Sheets

INPUT SKEW FEEDING AMOUNT Sk

SKEW FEEDING REGULATION AMOUNT $\delta = Ld/l$

TARGET SKEW FEEDING CORRECTION AMOUNT $\theta = Sk + \delta$

INPUT SKEW FEEDING AMOUNT Sk

SKEW FEEDING REGULATION AMOUNT $\delta = 0$

TARGET SKEW FEEDING CORRECTION AMOUNT $\theta = Sk$

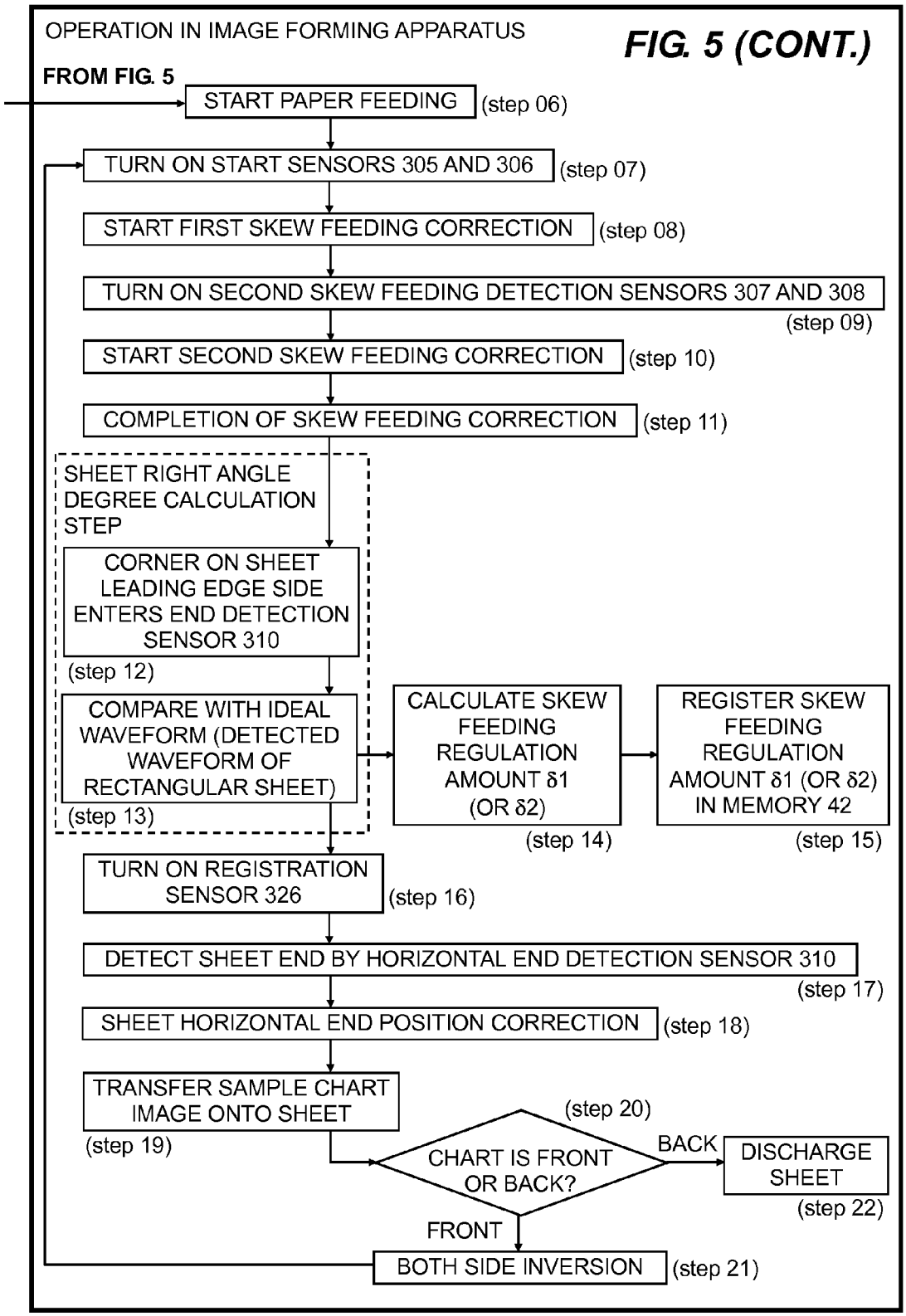
OPERATION IN IMAGE FORMING APPARATUS
FIG. 5 (CONT.)
FROM FIG. 5
START PAPER FEEDING
(step 06)
TURN ON START SENSORS 305 AND 306
(step 07)
START FIRST SKEW FEEDING CORRECTION
(step 08)
TURN ON SECOND SKEW FEEDING DETECTION SENSORS 307 AND 308
(step 09)
START SECOND SKEW FEEDING CORRECTION
(step 10)
COMPLETION OF SKEW FEEDING CORRECTION
(step 11)
SHEET RIGHT ANGLE DEGREE CALCULATION STEP
CORNER ON SHEET LEADING EDGE SIDE ENTERS END DETECTION SENSOR 310
(step 12)
COMPARE WITH IDEAL WAVEFORM (DETECTED WAVEFORM OF RECTANGULAR SHEET)
(step 13)
CALCULATE SKEW FEEDING REGULATION AMOUNT δ1 (OR δ2)
(step 14)
REGISTER SKEW FEEDING REGULATION AMOUNT δ1 (OR δ2) IN MEMORY 42
(step 15)
TURN ON REGISTRATION SENSOR 326
(step 16)
DETECT SHEET END BY HORIZONTAL END DETECTION SENSOR 310
(step 17)
SHEET HORIZONTAL END POSITION CORRECTION
(step 18)
TRANSFER SAMPLE CHART IMAGE ONTO SHEET
(step 19)
(step 20)
CHART IS FRONT OR BACK?
BACK
DISCHARGE SHEET
(step 22)
FRONT
BOTH SIDE INVERSION
(step 21)

FIG. 8A
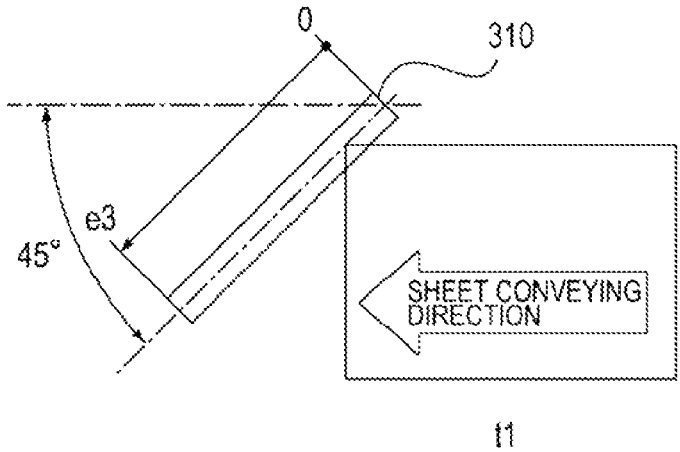
FIG. 8B
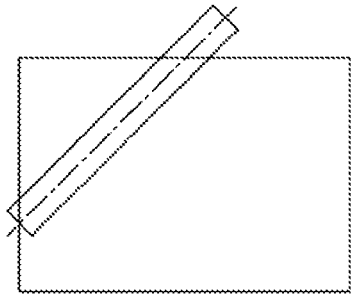
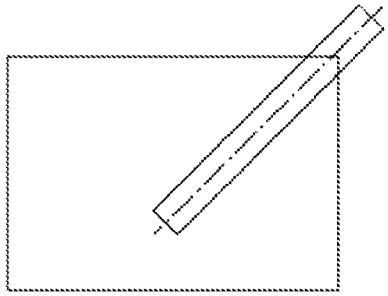
FIG. 8C
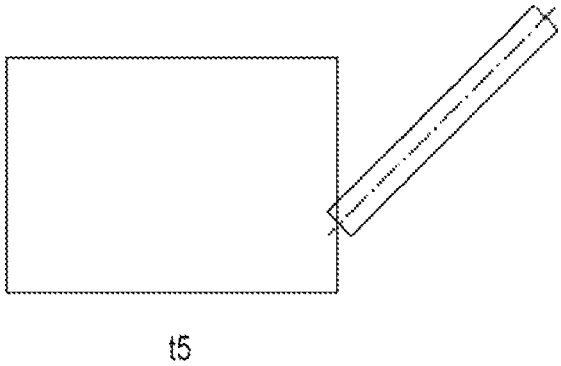
FIG. 8D

FIG. 9A
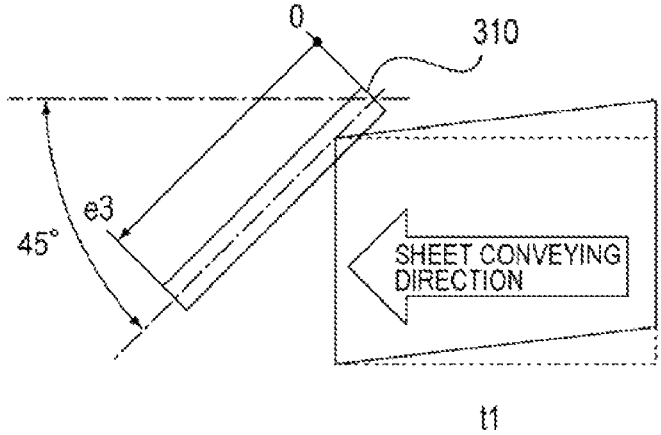
FIG. 9B
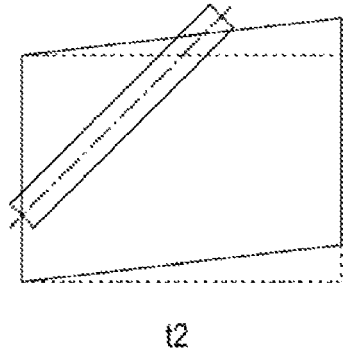
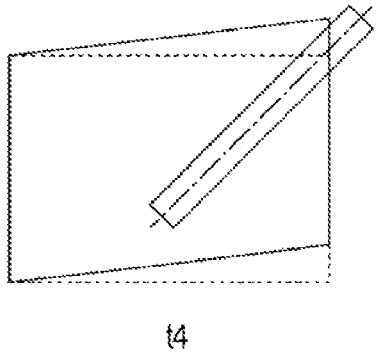
FIG. 9C
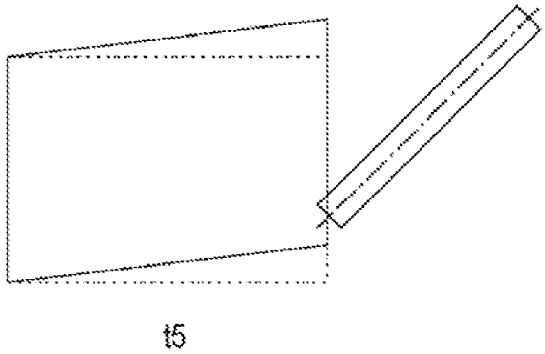
FIG. 9D ( SHEET RIGHT ANGLE DEGREE = 0)

( SHEET RIGHT ANGLE DEGREE = + )

( SHEET RIGHT ANGLE DEGREE = − )

FROM FIG. 12

SHEET CONVEYING APPARATUS AND IMAGE FORMING APPARATUS

BACKGROUND OF THE INVENTION

1. Field of the Invention

The present invention relates to a sheet conveying apparatus equipped in an image forming apparatus such as a copying machine, a printer, and a facsimile.

2. Description of the Related Art

In the prior art, an image forming apparatus such as a copying machine, a scanner, and a printer uses a sheet conveying apparatus (registration apparatus) provided immediately in front of an image forming portion of the image forming apparatus and used for controlling the posture and position of a sheet. For example, there have been proposed a loop registration method and a shutter registration method as a cost effective method. In the loop registration method, a leading edge of a sheet is abutted against a nip portion of a stopped roller pair so that the sheet is deflected, whereby skew feeding is corrected by the elasticity of the sheet.

Recently, in the image forming apparatus, the productivity of image formation is required to be improved. The productivity means the number of times of image formation per a unit time. High productivity can be obtained by reducing an interval between sheets (hereinafter referred to as a "sheet interval"). However, in the loop registration method and the shutter registration method, since the time of abutting the sheet leading edge against a blocking object to stop the sheet temporarily is required, the sheet interval corresponding to the stop time is increased. Thus, in order to reduce the registration time, an active registration method has been proposed.

In the active registration method, the skew feeding of a sheet is corrected by controlling a sheet conveying speed of skew feeding correction rollers which are arranged on the same axis as a sheet skew feeding amount detecting portion, the axis being perpendicular to a sheet conveying direction, and each independently driven. According to the active registration method, the skew feeding can be corrected while a sheet is conveyed, and the sheet interval can be reduced in comparison with other registration methods.

In the active registration method, in order to increase the skew feeding correction accuracy, there has proposed such a constitution that a conveying roller having a notch is rotated once to be controlled, so that the skew feeding is corrected simultaneously with phase control (see, U.S. Patent Application Publication No. 2008/0006992 A1).

However, a corner of a sheet is not always cut at a right angle, and in some types of sheets, the corners are not right angle. The degree of right angle of the corner of a sheet is determined when the sheet is cut, and therefore, when sheets are cut for each lot, the corners of the sheets have substantially the same angle in the same cutting lot. Accordingly, even if the skew feeding correction accuracy is increased by controlling the phase of the skew feeding correction roller, under the influence of the right angle degree of the sheet corner, positional deviation between front and back surface images (hereinafter referred to as "front and back deviation") may occur for example when images are formed on the both sides of a sheet.

Currently, in printing industry, deliverables in which the positions of the front and back surface images coincide with each other with high accuracy at low cost are required. With regard to the front and back deviation caused by the right angle degree of the sheet corner, a user regulates the skew feeding amount for each of the front and back surfaces to correspond to the positional alignment between the front and back surface images. However, a user should perform the operation of aligning the positions of the front and back surface images with high accuracy, so that trouble and a lot of time to perform the operation are required.

In the positional alignment between the front and back surface images by a user, the user outputs a sample image and then confirms the positional relationship between the sample image and an end of a sheet, and the user per se should calculate a sheet skew feeding regulation amount that does not cause the front and back deviation. The user inputs the calculated skew feeding regulation amount through an operation portion to output the sample image again, and, thus, to confirm that the sheet and the sample image have a desired positional relationship. In order to perform such an operation with high accuracy, the same operation needs to be repeated, so that trouble and a lot of time are required. Further, as described above, the cutting lot of a sheet and the right angle degree of the sheet corner are correlated, and therefore, when the positions of the front and back surface images are aligned with high accuracy, a user is required to perform the above operation for each cutting lot.

Furthermore, a user is required to perform two types of skew feeding regulations according to the use of the sheet for the following reason. Usually, the skew feeding is regulated so that an image is parallel to the long side of a sheet (the side in the sheet conveying direction) amongst the short and long sides forming the corner of the sheet. However, when a sheet processing apparatus such as a finisher, which applies processing to a sheet, is attached downstream from a discharge opening of an image forming apparatus, other methods may be employed. In the sheet processing apparatus, staple processing and punching processing are performed with high accuracy by mechanically abutting the leading edge in the sheet conveying direction of a sheet. Accordingly, when the sheet conveying direction leading edge of the sheet is the short side forming the corner of the sheet, it is preferable that the skew feeding is regulated so that an image is parallel to the short side of the sheet (the leading edge side). Accordingly, with regard to a continuous form of sheet whose long side corresponds to the sheet conveying direction, the skew feeding regulation amount should be set so that the short side of the sheet is parallel to an image. Thus, according to presence of the sheet processing, a user should separately perform two types of skew feeding regulations, i.e. based on the short side of the sheet and on the long side basis. Consequently, it takes time and trouble.

In view of the above problems, the present invention provides a sheet conveying apparatus that reduces the trouble (burden) required for sheet skew feeding regulation by a user even when a corner of a sheet is not right angle.

SUMMARY OF THE INVENTION

The present invention provides a sheet conveying apparatus, which conveys a sheet toward an image forming portion forming an image on a sheet, including a skew feeding correcting portion which corrects skew feeding of the sheet, a sheet end detecting portion which detects a corner on the conveying direction leading edge side of the sheet being conveyed and two sides forming the corner and detects a right angle degree of the corner, a controlling portion which regulates a sheet skew feeding correction amount by the skew feeding correcting portion based on the sheet right angle degree detected by the sheet end detecting portion, and a controlling portion automatically calculates based on the sheet right angle degree detected by the sheet end detecting portion, a skew feeding regulation amount used for making any one of the two sides, forming the corner of the sheet, parallel to the image to be formed on the sheet by the image forming portion and the controlling portion controls the skew feeding correcting portion so as to correct the skew feeding of the sheet based on the skew feeding regulation amount so that any one of the two sides forming the corner of the sheet is parallel to the image.

According to the present invention, even when a sheet whose corners are not right angle is used, the trouble (burden) required for sheet skew feeding regulation by a user can be reduced.

Further features of the present invention will become apparent from the following description of exemplary embodiments with reference to the attached drawings.

BRIEF DESCRIPTION OF THE DRAWINGS

FIG. 1A is a schematic upper view of a registration portion, FIG. 1B is a view exemplifying a sheet whose corners are not right angle, and FIGS. 1C and 1D are views exemplifying deliverables obtained by forming an image on a sheet;

FIG. 7A is a view illustrating arrangement of the end detection sensor, FIG. 7B is a schematic side view illustrating a detection state detected by the end detection sensor, and FIG. 7C is a view illustrating distribution of a light receiving amount of the end detection sensor;

FIGS. 8A to 8E are views illustrating detection waveforms of a sheet detected by the end detection sensor when the corners of the sheet are right angle, according to the first embodiment;

FIGS. 9A to 9E are view illustrating the detection waveforms of a sheet detected by the end detection sensor when the corners of the sheet are not right angle, according to the first embodiment;

DESCRIPTION OF THE EMBODIMENTS

Hereinafter, the preferred embodiments of the present invention will be exemplarily described in detail with reference to the drawings. However, dimensions, materials, shapes of constituents described in the following embodiments, relative arrangement of the constituents, and the like should be appropriately modified depending on the configuration and various conditions of an apparatus to which the invention is applied, and it is not intended to limit the scope of the present invention only to the following embodiments unless particularly specified.

First Embodiment

Figure 1A:
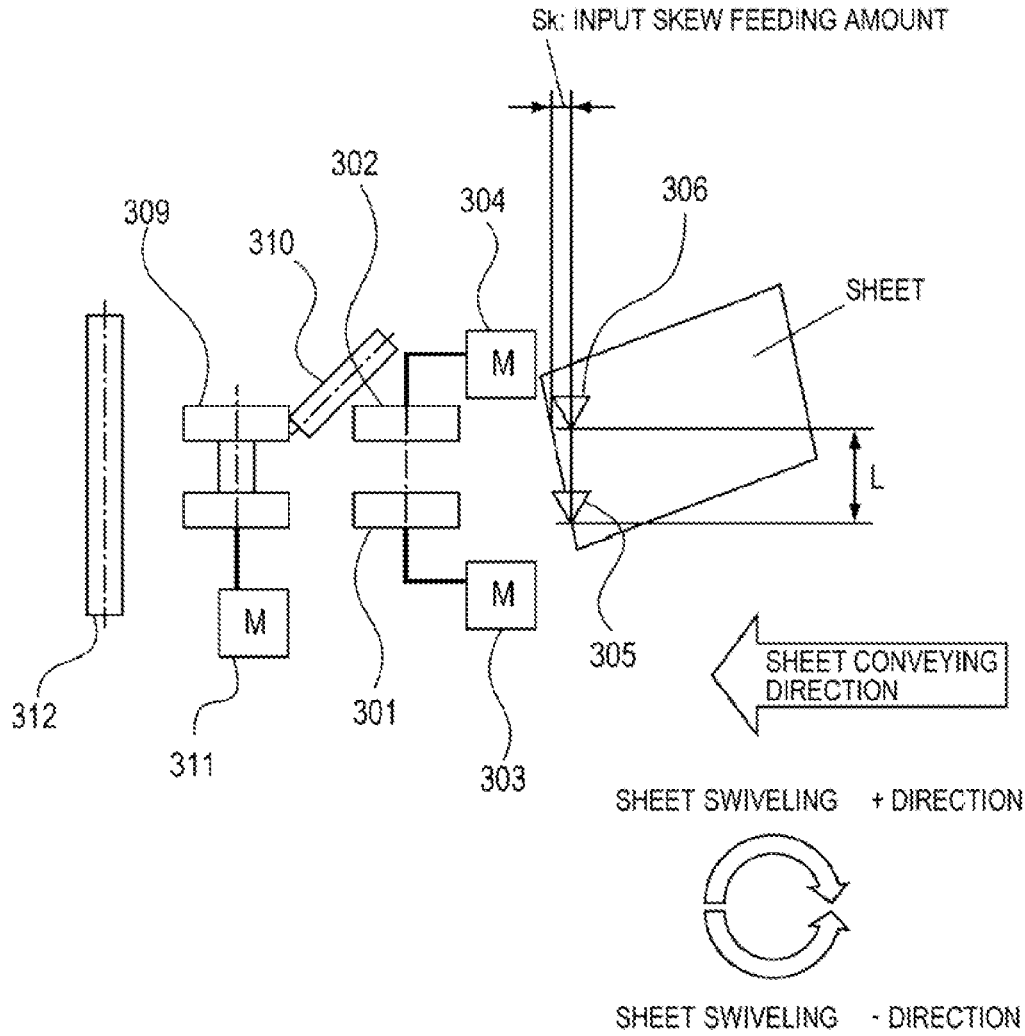
FIGS. 1A to 1D are explanatory views for describing a sheet skew feeding regulation amount.
Figure 1B:
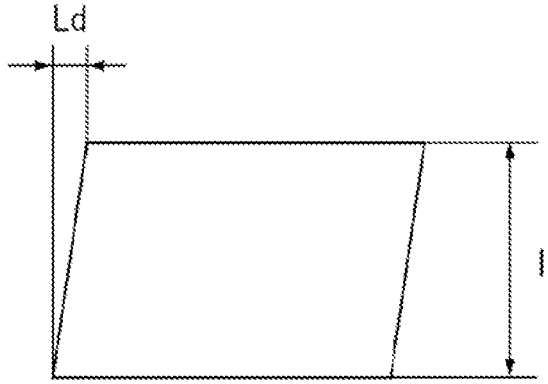
Figure 1C:
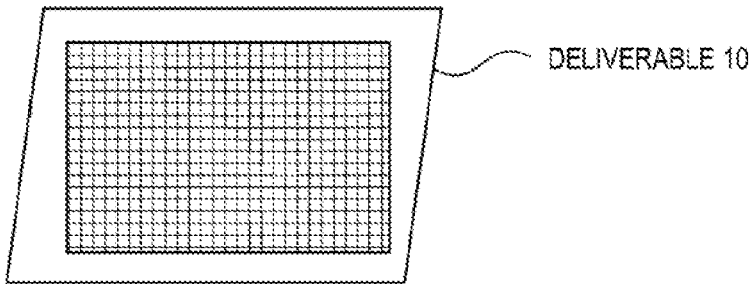
Figure 1D:
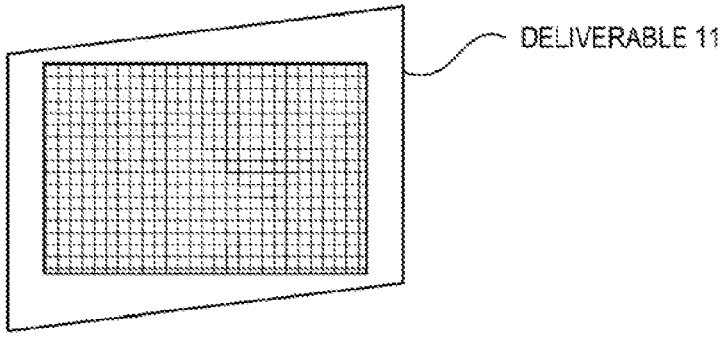
Figure 2:
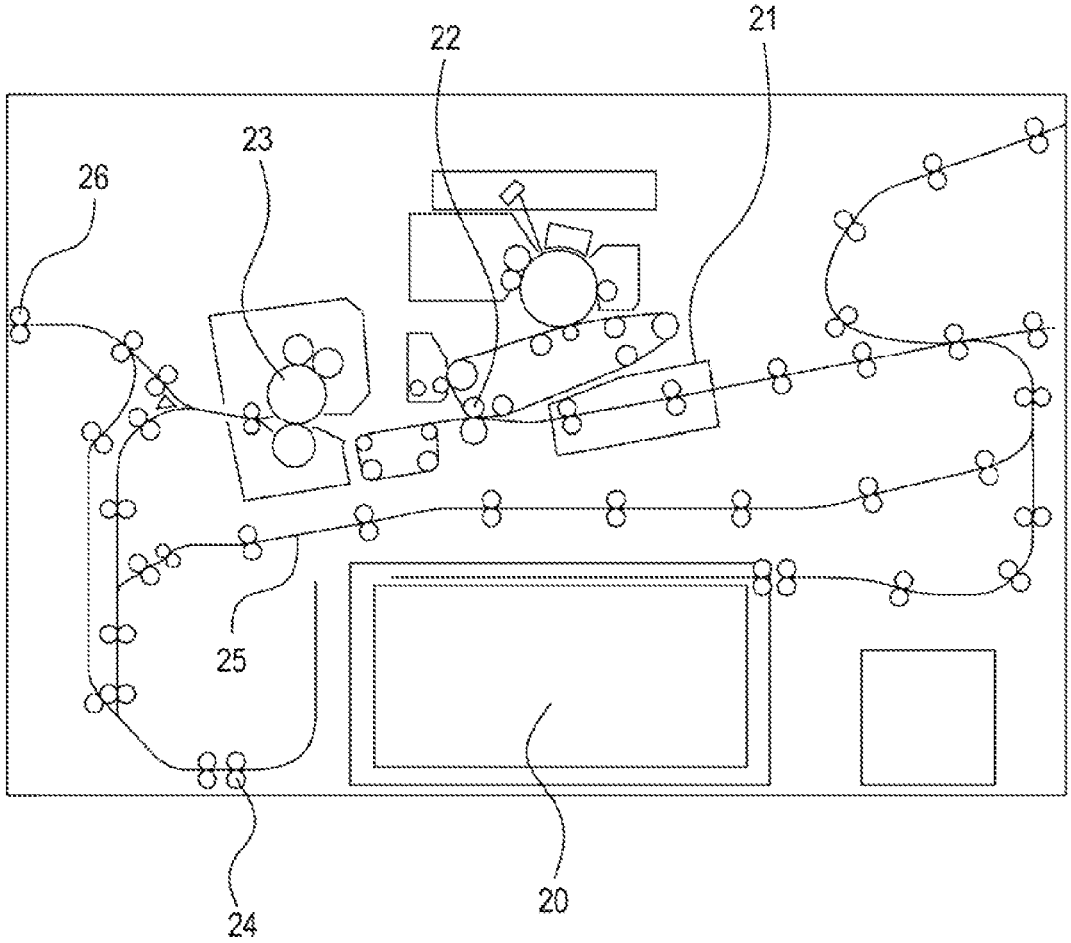
FIG. 2 is a schematic cross-sectional view of an image forming apparatus including the registration portion.
Figure 3:
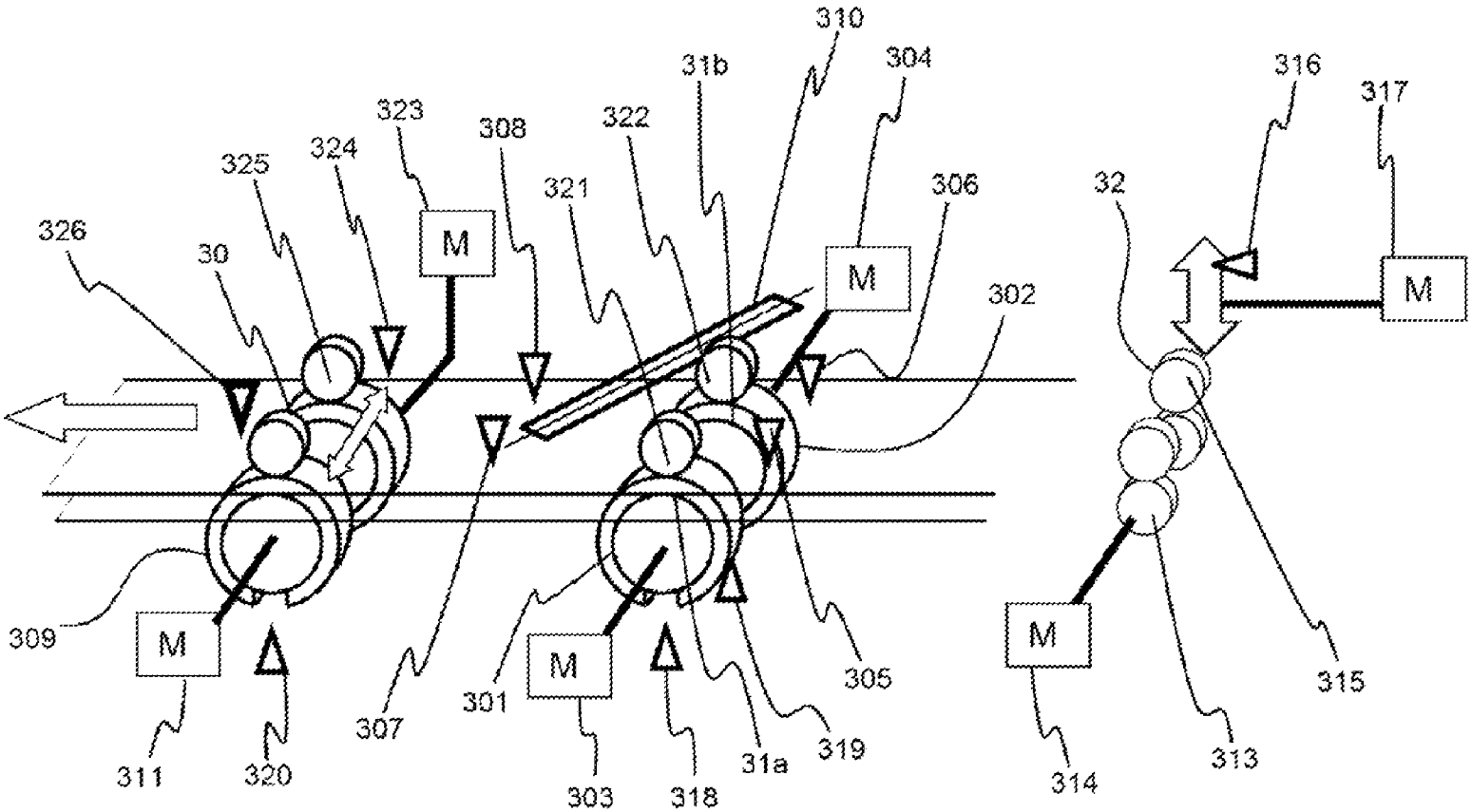
FIG. 3 is a schematic perspective view of the registration portion according to a first embodiment.

A first embodiment will be described with reference to FIGS. 1 to 9, exemplifying an image forming apparatus including a sheet conveying apparatus. FIG. 2 is a schematic cross-sectional view of a printer as an image forming apparatus including a registration apparatus (hereinafter referred to as a registration portion 21) as a sheet conveying apparatus according to the first embodiment. FIG. 3 is a schematic perspective view of the registration portion 21.

First, a schematic configuration of the image forming apparatus will be described briefly. As illustrated in FIG. 2, a sheet fed from a sheet feeding portion 20 is sent to an image transfer portion 22 in an image forming portion through the registration portion 21. An image is transferred onto the sheet by the image transfer portion 22 and then fixed by a fixing portion 23. In single-sided printing, the sheet fixed with the image is discharged outside the apparatus from the discharge opening 26. Meanwhile, in double-sided printing, a sheet in which an image is fixed onto a single side thereof is conveyed to an inversion path 24, switch back operation is then performed, and the sheet passes through a duplex conveying path 25 and is then sent to the registration portion 21 again. After that, the image is transferred and then fixed to the sheet, and the sheet is conveyed outside the apparatus from the discharge opening 26. When the sheet processing apparatus is connected to the image forming apparatus in a detachably attachable manner, a sheet discharged from the discharge opening 26 is given to the sheet processing apparatus, and processing such as stapling and punching is selectively performed.

Next, the present embodiment will be described in detail, exemplifying skew feeding amount automatic regulation using a sample image. In the following description, a schematic configuration of the registration portion according to the present embodiment, the mechanism of right angle degree measurement using an end detection sensor, and a flow of automatic setting of a target skew feeding correction amount θ according to the type of printing job considering a processing process will be described in this order.

As illustrated in FIG. 3, the registration portion 21 has a pre-registration roller pair 32, skew feeding correction roller pairs 31*a* and 31*b* as skew feeding correcting portions, and a registration roller pair 30 provided sequentially from the upstream in the sheet conveying direction. The pre-registration roller pair 32, the skew feeding correction roller pairs 31*a* and 31*b*, and the registration roller pair 30 are rotatably axially supported by a frame (not illustrated).

The pre-registration roller pair 32 includes a pre-registration drive roller 313 and a pre-registration driven roller 315 pressurized by a pressure spring (not illustrated). The pre-registration drive roller 313 is connected to a pre-registration drive motor 314 for driving the pre-registration drive roller 313 in the sheet conveying direction. In the pre-registration driven roller 315, a pre-registration release motor 317 for releasing pressurization of the pre-registration roller pair 32 and a pre-registration release HP sensor 316 for detecting the phase of the pre-registration release motor 317 are arranged.

A skew feeding correction roller pair includes the two skew feeding correction roller pairs 31*a* and 31*b* arranged at a predetermined interval L in a direction perpendicular to the sheet conveying direction. The skew feeding correction roller pairs 31*a* and 31*b* are skew feeding correcting portions which correct the skew feeding of a sheet by swiveling the sheet while conveying the sheet. The skew feeding correction roller pairs 31*a* and 31*b* include C-shaped skew feeding correction drive rollers 301 and 302 and skew feeding correction driven rollers 321 and 322 pressurized by a pressure spring (not illustrated). The skew feeding correction drive rollers 301 and 302 are connected to skew feeding correction motors 303 and 304. In the skew feeding correction drive rollers 301 and 302, skew feeding correction HP sensors 318 and 319 for detecting the rotational phase of the respective rollers are arranged. The skew feeding correction drive rollers 301 and 302 are independently driven.

Start sensors 305 and 306 for starting the skew feeding correction motors 303 and 304 are provided on the upstream in the sheet conveying direction of the skew feeding correction roller pairs 31*a* and 31*b*, respectively and arranged at the predetermined interval L in the direction perpendicular to the sheet conveying direction. The start sensors 305 and 306 are first skew feeding detecting portions which detect the skew feeding of a sheet. The skew feeding correction motors 303 and 304 are started in synchronization with detection of the sheet leading edge by the start sensors 305 and 306, and the skew feeding correction roller pairs 31*a* and 31*b* are rotated and driven. In such a state that cut-out portions of the peripheral surfaces of the skew feeding correction drive rollers 301 and 302 face the skew feeding correction driven rollers 321 and 322, roller nip portions between the skew feeding correction drive rollers 301 and 302 and the skew feeding correction driven rollers 321 and 322 are released. Namely, in such a state that the roller nip portions between the skew feeding correction drive rollers 301 and 302 and the skew feeding correction driven rollers 321 and 322 are released, the nipping of the sheet is released.

Second skew feeding detection sensors 307 and 308 are arranged on the downstream in the sheet conveying direction of the skew feeding correction roller pairs 31*a* and 31*b*. The second skew feeding detection sensors 307 and 308 are second skew feeding detecting portions used when the skew feeding amount detected by the start sensors 305 and 306 cannot be completely corrected in the first skew feeding correction operation. The second skew feeding detection sensors 307 and 308 are the second skew feeding detecting portions which detect the sheet skew feeding, and following the first skew feeding correction operation, the second skew feeding correction operation based on the detection by the sensors is performed while the sheet is nipped by the skew feeding correction roller pairs 31*a* and 31*b*.

The skew feeding correction roller pairs 31*a* and 31*b*, the start sensors 305 and 306, and the second skew feeding detection sensors 307 and 308 constitute a skew feeding correcting portion for correcting the sheet skew feeding.

The registration roller pair 30 having an individual driving source is arranged on the downstream in the sheet conveying direction of the skew feeding correction roller pairs 31*a* and 31*b*. As the functions of the registration roller pair 30, the registration roller pair 30 receives a sheet from the skew feeding correction roller pairs 31*a* and 31*b*, then moves the sheet in the direction (roller shaft direction) perpendicular to the sheet conveying direction while conveying the sheet, and thereby aligns the position in the roller shaft direction of the sheet with respect to an image. The registration roller pair 30 includes a C-shaped registration roller 309 and a registration driven roller 325 pressurized by a pressure spring (not illustrated). In such a state that a cut-out portion of the peripheral surface of the registration roller 309 faces the registration driven roller 325, a roller nip portion between the registration roller 309 and the registration driven roller 325 is released. Namely, in such a state that the roller nip portion between the registration roller 309 and the registration driven roller 325 is released, the nip of the sheet is released.

In the registration roller 309, a registration motor 311 for driving the registration roller 309 in the sheet conveying direction and a registration HP sensor 320 for detecting the rotational phase of the registration roller 309 are arranged. Further, a registration shift motor 323 for driving the registration roller pair 30 in the direction perpendicular to the sheet conveying direction and a registration shift HP sensor 324 are arranged.

An end detection sensor 310 is arranged on the upstream in the sheet conveying direction of the registration roller pair 30. The end detection sensor 310 detects the position of a sheet end, the position of a side on the sheet conveying direction leading edge side of a sheet, and the position of a side substantially parallel to the sheet conveying direction of the sheet and measures the sheet right angle degree. The end detection sensor 310 is arranged to be inclined by a predetermined angle (herein 45°) with respect to the sheet conveying direction. The end detection sensor 310 is provided on the downstream in the sheet conveying direction of the skew feeding correction roller pairs 31*a* and 31*b* and is a sheet end detecting portion which detects the right angle degree of a sheet whose skew feeding is corrected by the skew feeding correcting portion.

A registration sensor 326 is arranged on the downstream of the registration roller pair 30. The registration sensor 326 detects the sheet leading edge to determine the timing of operation of sliding the registration roller pair 30 in the direction perpendicular to the sheet conveying direction.

A method of regulating the skew feeding amount that is performed when the sheet corner is not right angle will be herein described. FIG. 1 illustrates states before and after the sheet skew feeding correction. In FIG. 1, Ld represents the right angle degree obtained when the sheet corner is not cut at a right angle, and l represents length in the direction perpendicular to the sheet conveying direction. The sheet skew feeding correction is performed by the skew feeding correction roller pairs 31*a* and 31*b* so that a sheet skew feeding amount Sk detected by the start sensors 305 and 306 is 0. A deliverable obtained by forming an image on a sheet subjected to the skew feeding correction thus is a deliverable 11 illustrated in FIG. 1. However, in order to make the long side of a sheet parallel to an image as illustrated in a deliverable 10, the skew feeding amount Sk is required to be regulated according to the sheet right angle degree Ld. In the deliverable 10, the skew feeding correction is performed by the skew feeding correction amount $\theta = Sk + Ld/l$ ($\theta$ is defined as a "target skew feeding correction amount") obtained by adding regulation of Ld/l to the skew feeding amount Sk, whereby the long side of the sheet can be made parallel to the image. In the present embodiment, a regulation value $\delta = Ld/l$ corresponding to the sheet right angle degree is defined as a "skew feeding regulation amount $\delta$". The operation of determining the skew feeding regulation amount $\delta$ is referred to as "skew feeding amount regulation".

Figure 4:
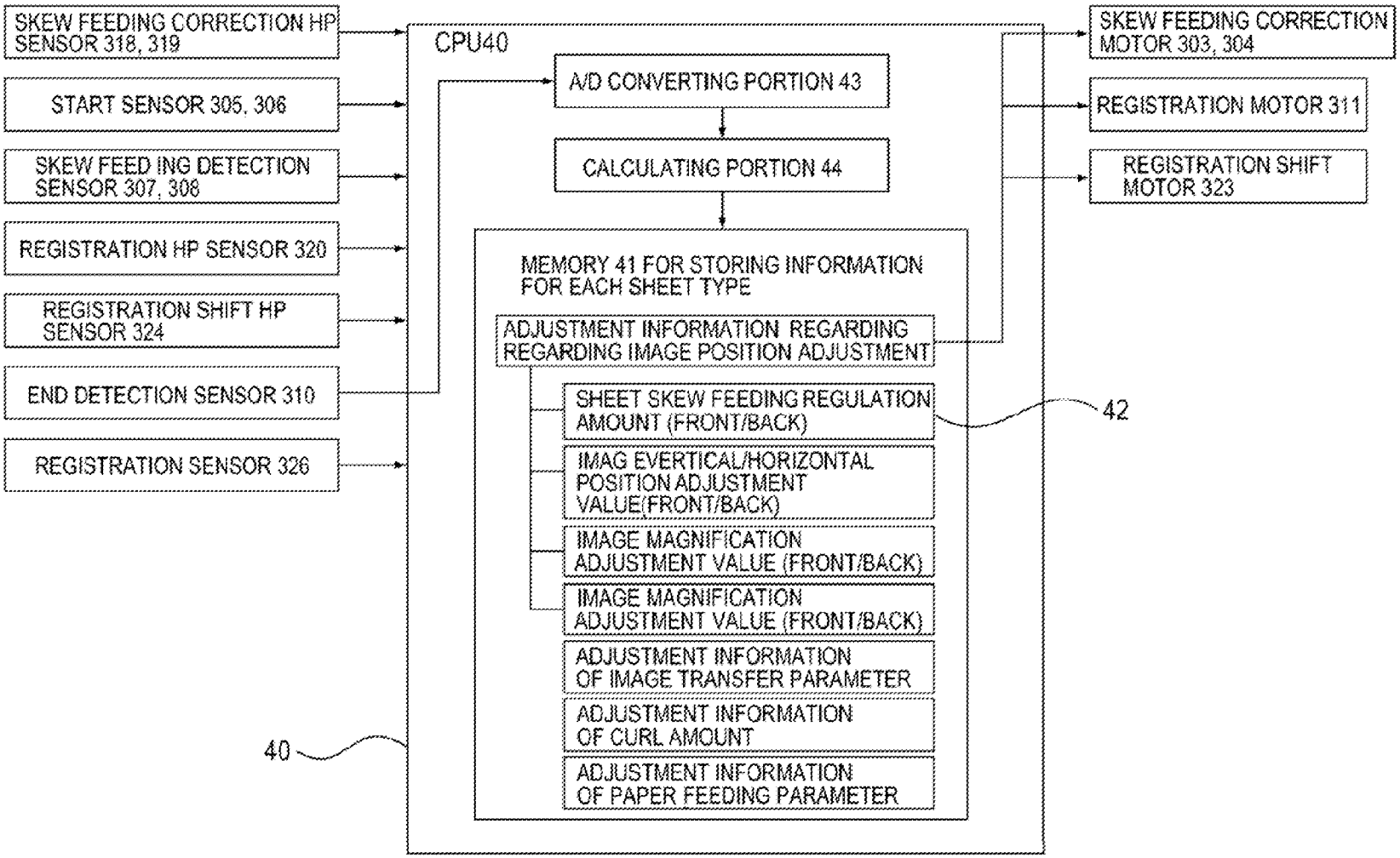
FIG. 4 is a block diagram illustrating a flow of information to calculation of a target skew feeding correction amount from a detected skew feeding amount.

Next, the flow of information of the skew feeding regulation amount $\delta$ will be described with reference to a block diagram illustrating the input and output structure of the information. FIG. 4 is a block diagram illustrating the flow of the information to calculation of a target skew feeding correction amount from a detected skew feeding amount.

A controller (a controlling portion) (not illustrated) of the image forming apparatus includes a CPU 40, and the CPU 40 includes a memory 41 which stores information such as regulation parameters for each sheet type. The memory 41 stores adjustment information regarding image position adjustment, adjustment information of an image transfer parameter (transfer current), adjustment information of a curl correction amount, adjustment information of a paper-feeding parameter, and so on. The memory 41 includes a storage portion 42 (hereinafter referred to as a memory 42) which stores the sheet skew feeding regulation amount (front/back) as one of the adjustment information regarding the image position adjustment. The adjustment information regarding the image position adjustment further includes adjustment values (front/back) of the vertical and horizontal positions of an image and an adjustment value (front/back) of an image magnification.

The above sensors are connected to the CPU 40, and the CPU 40 controls driving of each motor based on the information detected by each sensor. Of the detected information, time-series information of the sheet end position detected by the end detection sensor 310 is binarized by an A/D converting portion 43, converted into the skew feeding regulation amount δ by a calculating portion 44, and thereafter stored as the parameter for each sheet type in the memory 42. When the appropriate sheet is printed, the skew feeding regulation amount δ is called from the memory 42 to be used when the skew feeding correction motors 303 and 304 are driven. The different skew feeding regulation amounts δ are used according to the front and back surfaces of a sheet. Specifically, the front surface is registered as a skew feeding regulation amount δ1 in the memory 42, and the back surface is registered as a skew feeding regulation amount δ2 in the memory 42.

Next, detection of the sheet right angle degree Ld using a sample chart (sample image) and the operation at the time of printing using the detected right angle degree Ld will be described in detail using the registration portion illustrated in FIG. 3 and a flow chart of FIG. 5. In the present embodiment, regarding a type of sheet to be passed for the first time, it is assumed that a user of the image forming apparatus starts a printing job after outputting the sample chart.

Figure 5:
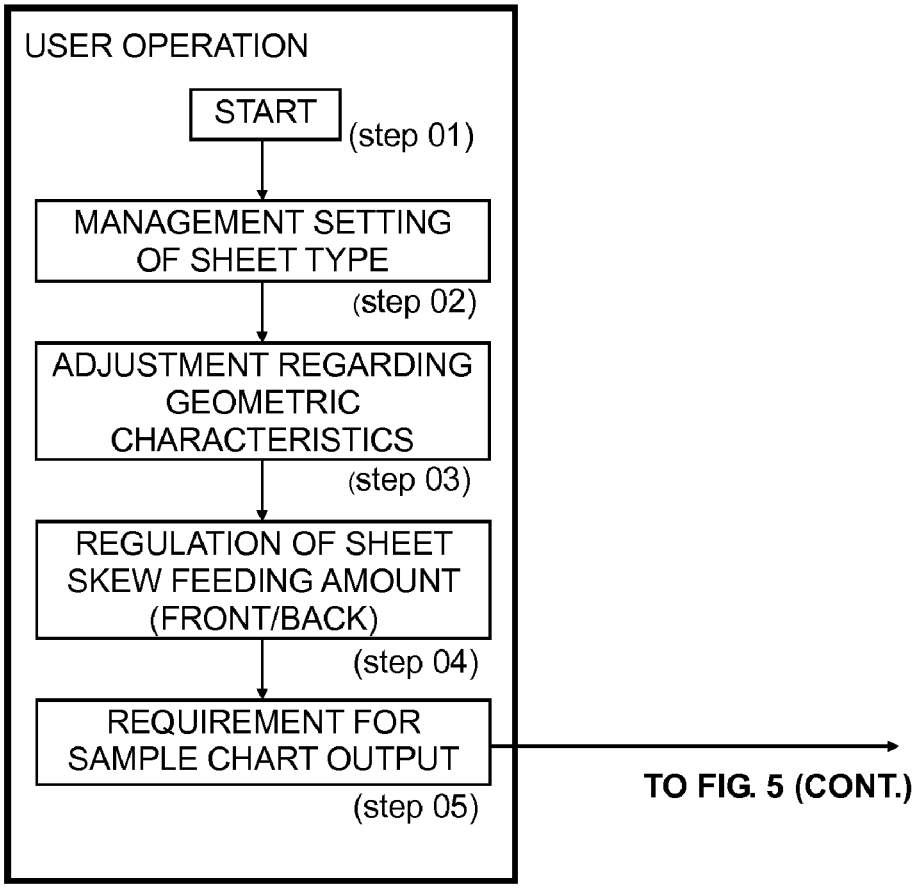
FIG. 5 is a flow chart of a sample chart output according to the first embodiment.

As illustrated in FIG. 5, a user first sets a sheet for output of the sample chart (step 01). When adjustment regarding geometric characteristics (step 03) in a menu of management setting of a sheet type (step 02) and regulation of the sheet skew feeding amount (front/back surface) (step 04) are selected, the sample chart is required to be output, and then paper feeding is started (step 06). When the sheet leading edge conveyed to the registration portion is detected by the start sensors 305 and 306 (step 07), the skew feeding correction motors 303 and 304 are started based on the respective sensors, and the skew feeding correction roller pairs 31*a* and 31*b* with the released roller nip portions are rotated to convey the sheet. The target skew feeding correction amount θ (=Sk) is calculated from a detection time difference in the start sensors 305 and 306, and the first skew feeding correction is performed (step 08). When the skew feeding is not completely corrected, the sheet skew feeding amount is detected by the downstream second skew feeding detection sensors 307 and 308 (step 09), and the second skew feeding correction is performed (step 10). After completion of the sheet skew feeding correction (step 11), the right angle degree of the corner on the sheet leading edge side is measured by the end detection sensor 310 and registered in the memory 42 (steps 12 to 15).

If the sheet is conveyed by the skew feeding correction roller pairs 31*a* and 31*b*, then upon entering of the corner on the sheet leading edge side into the end detection sensor 310, the measurement of the sheet right angle degree Ld is started (step 12). The right angle degree Ld of the sheet leading edge corner is calculated by comparing time-series end position detection data of the end detection sensor 310 with ideal waveform data (the end position detection data obtained when a rectangular sheet is conveyed) (step 13). The skew feeding regulation amount δ1 of the front surface of the sheet is automatically calculated from the right angle degree Ld of the sheet leading edge corner by the CPU 40 (step 14) to be registered in the memory 42 (step 15).

After completion of the sheet skew feeding correction, the sheet is conveyed downstream by the skew feeding correction roller pairs 31*a* and 31*b* to be given to the registration roller pair 30. After the sheet is nipped by the registration roller pair 30, when the sheet leading edge passes through the registration sensor 326 (step 16), the sheet end position is detected by the end detection sensor 310 (step 17). The detection of the sheet end position is performed in order to shift the sheet in the roller shaft direction to make the position of the sheet coincide with the position of an image. In the detection of the sheet end position, only the position of the end perpendicular to the roller shaft direction of the sheet is detected. The amount of the movement of the sheet in the width direction (roller shaft direction) is calculated simultaneously with the detection of the sheet end position, and the registration roller pair 30 moves the sheet in the roller shaft direction by a predetermined amount while nipping the sheet, whereby the position in the roller shaft direction of the sheet coincides with the position of an image (step 18). The above operation is hereinafter referred to as "horizontal end position correction".

The sheet subjected to the skew feeding correction and the horizontal end position correction is further conveyed downstream by the registration roller pair 30, and a sample chart image is transferred onto the sheet (step 19). Thereafter, when the image-transferred surface of the sheet is a front surface (step 20), inversion operation of inverting the front and back surfaces of a sheet is performed (step 21). After the inversion operation, the skew feeding correction is performed again in steps 07 to 11, and the right angle degree Ld of the corner of the leading edge of the back surface of a sheet (the right angle degree of the rear end of the front surface of the sheet) is measured by the end detection sensor 310. The skew feeding regulation amount δ2 of the sheet back surface is automatically calculated from the sheet right angle degree Ld by the CPU 40 to be registered in the memory 42. Thereafter, the horizontal end position correction is performed, and the sheet transferred with the sample chart image is discharged outside the image forming apparatus (step 22). The positional accuracy and transfer state of an image, curling of the sheet, and so on are checked by a user.

Figure 7A:
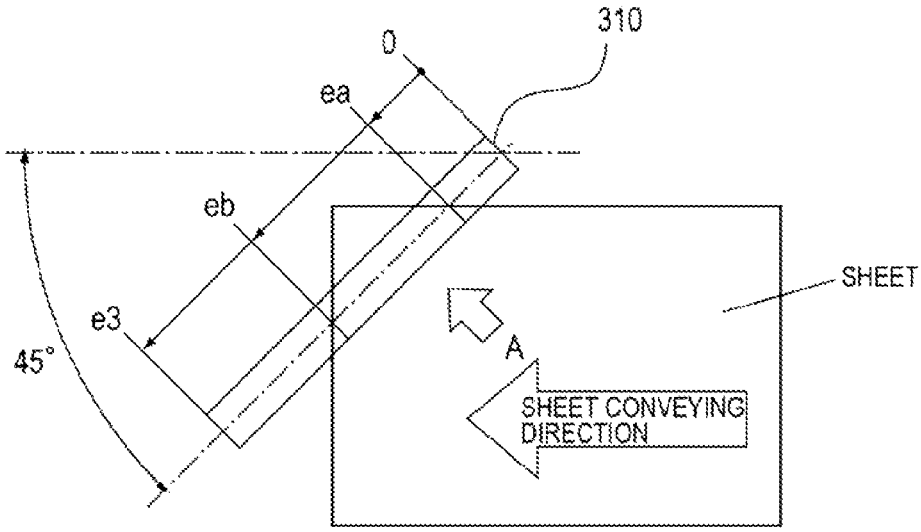
FIGS. 7A to 7C are views illustrating sheet end detection by an end detection sensor.
Figure 7B:
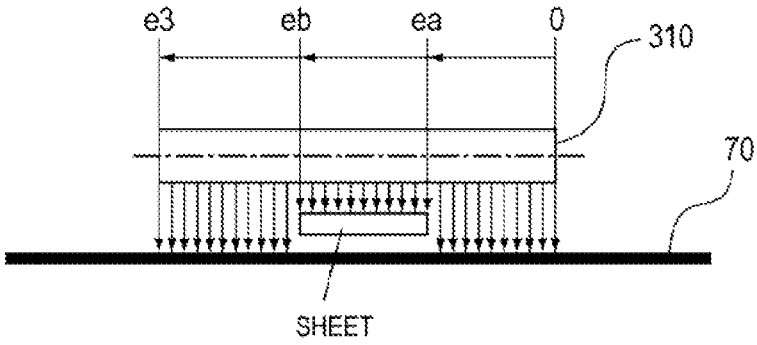
Figure 7C:
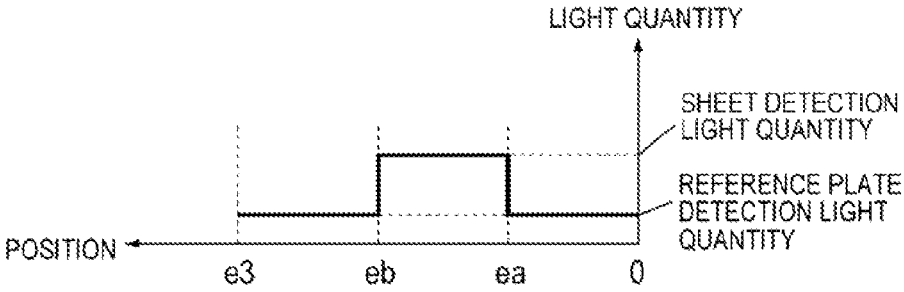

Next, the mechanism of the right angle degree detection by the end detection sensor 310 will be exemplified and described. FIG. 7 illustrates a state that the sheet is conveyed to the end detection sensor 310 and the corner on the leading edge side of the sheet is detected by the end detection sensor 310. The end detection sensor 310 is arranged to be inclined by 45° with respect to the sheet conveying direction. The end detection sensor 310 has such a constitution that a plurality of reflective type optical sensors is arrayed on one axis, and a difference between the quantity of light reflected by and returned from a facing reference plate and the quantity of light reflected by and returned from a sheet is detected. According to this constitution, the sheet end position can be grasped. A reference position and a detection limit position of the end detection sensor 310 are represented respectively by 0 and $e_3$. In the state of FIG. 7, the end detection sensor 310 detects a quantity of light reflected by the reference plate at the position from 0 to $e_a$ and the position from $e_b$ to $e_3$ and the quantity of light reflected by the sheet at the position from $e_a$ to $e_b$.

Accordingly, a sheet detection area is the position from $e_a$ to $e_b$. The sheet end position on the back side at the leading edge is detected as $e_a$, and the end position on the sheet leading edge side is detected as $e_b$.

The end detection sensor 310 detects a corner on the leading edge of a sheet being conveyed in the sheet conveying direction and two sides forming the sheet corner to detect the right angle degree of the sheet corner. In the following description, the detected waveforms obtained when the corner of the sheet leading edge is right angle and when it is not right angle are exemplified.

Figure 8E:
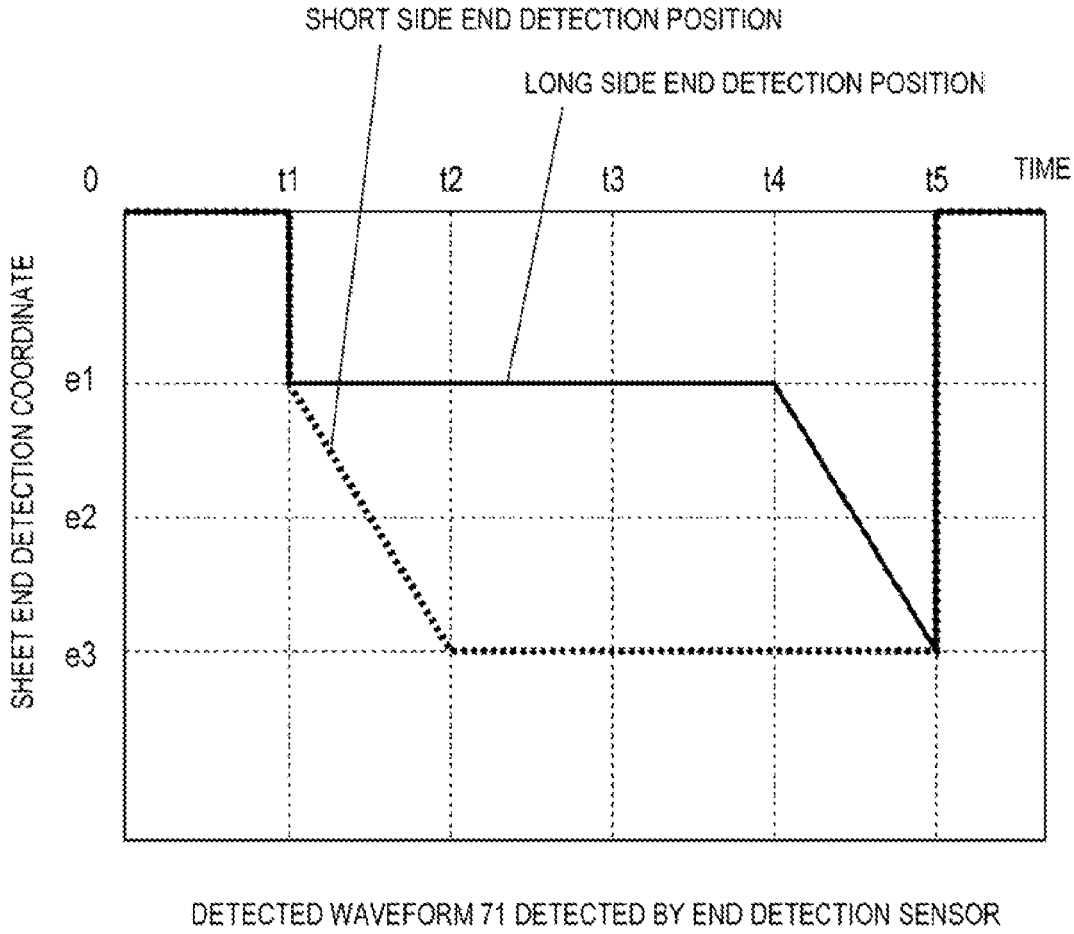

FIG. 8 illustrates the waveforms detected by the end detection sensor 310 when the sheet corner is cut at a right angle. When the corner of the sheet leading edge enters the end detection sensor 310, the waveform in which a portion where the end detection sensor 310 is blocked by the sheet and a portion where the end detection sensor 310 is not blocked are binarized is obtained as illustrated by a detected waveform 71 of FIG. 8. A time when the sheet enters the end detection sensor 310 is represented by t1, and a time when the leading edge of a sheet reaches a limit detecting point of the end detection sensor 310 is represented by t2. A time when the corner of the sheet rear end enters the end detection sensor 310 when the sheet is further conveyed downstream is represented by t4, and a time when the sheet rear end passes by the limit detecting point of the end detection sensor 310 is represented by t5. The time t3 is the time of calculating the sheet right angle degree and is set to be later than the time t1 and faster than the time t4. When the intervals of the times t1 to t3 are set to be as long as possible, the right angle degree can be measured with higher accuracy. Hence, the intervals of the times t1 to t3 are set to be as long as possible according to a sheet size.

Figure 9E:
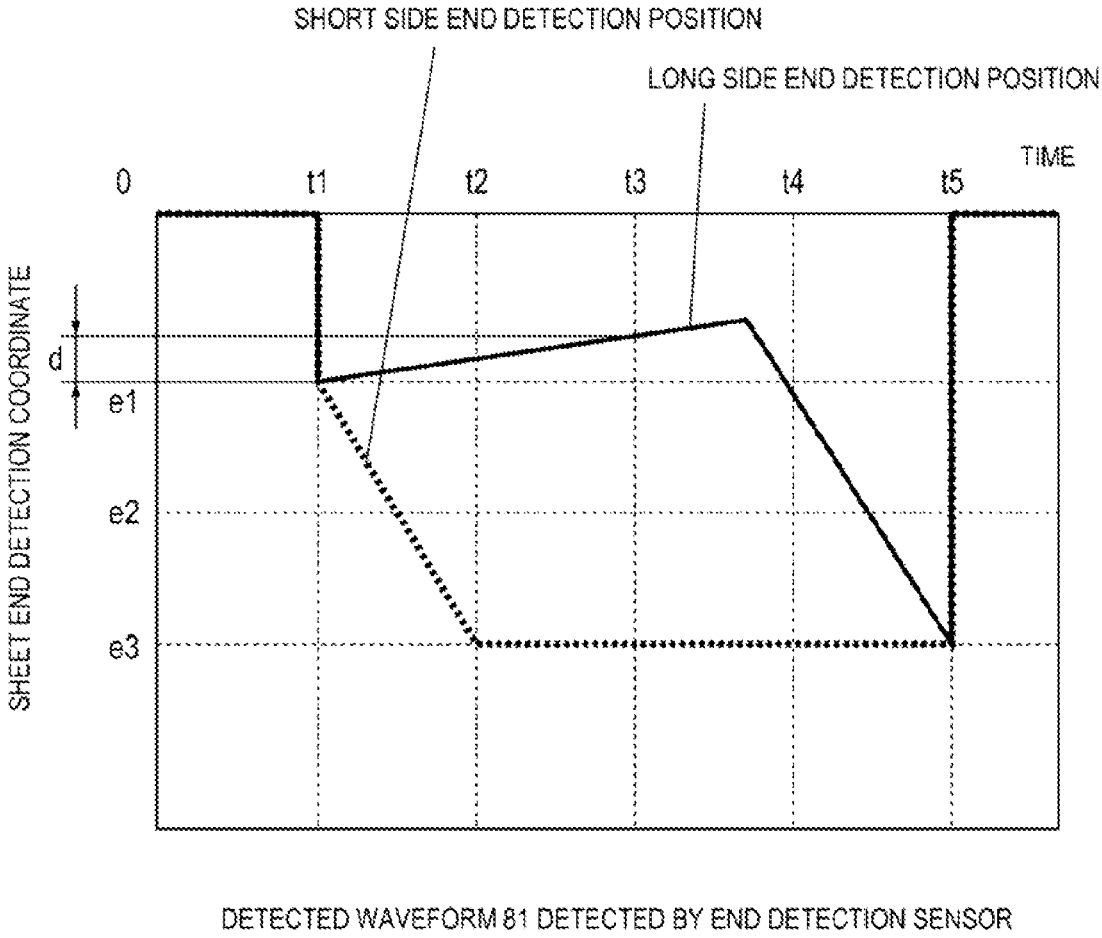

Next, a difference between the detected waveforms due to a difference between the right angel degrees of the sheet leading edge corners will be described. FIGS. 8 and 9 respectively illustrate the waveforms detected by the end detection sensor 310 when the sheet corner is right angle and when it is not right angle. In comparison with the detected waveform 71 (see, FIG. 8) of the sheet whose corners are right angle, a detected waveform 81 (see, FIG. 9) of a sheet whose corners are not right angle is measured that the sheet right angle degree is different by d between the times t1 and t3. Accordingly, by using a distance L in the direction perpendicular to the sheet conveying direction between the sensors 305 and 306 as the first sheet skew feeding detecting portions and between the sensors 307 and 308 as the second sheet skew feeding detecting portions and a sheet conveying speed V, a relationship of $V(t3-t1):L=d:\delta$ is established with the skew feeding regulation amount δ.

From the above, the skew feeding regulation amount δ can be represented by $\delta=Ld/V(t3-t1)$ and is calculated from this formula.

As described above, the sheet right angle degree Ld (see, FIG. 1) can be measured, and the sheet skew feeding regulation amount δ can be calculated. The automatically calculated skew feeding regulation amount δ is stored, as the skew feeding regulation amount δ of the sheet type selected by a user, in the memory 42 and is used when the printing job using the appropriate sheet is performed.

The skew feeding regulation amount δ has an affect on the sheet right angle degree Ld. A user outputs the sample chart image only once when the cutting lot of a sheet is changed, whereby the skew feeding regulation amount δ of each medium can be managed.

However, according to a processing process in the sheet processing apparatus after printing, two types of skew feeding amount regulation operations are required to be performed. Specifically, the skew feeding amount regulation operation based on the short side of a sheet and the operation on the long side basis are performed. The skew feeding regulation amount δ should be managed for each sheet, and the operation occupies a large part of the burden on a user.

Accordingly, in the controlling portion, when the processing process is performed by the sheet processing apparatus, the sheet skew feeding is corrected by the skew feeding correcting portion so that the side (herein the short side) on the sheet conveying direction leading edge side that is one side forming the sheet corner is parallel to an image. Meanwhile, when there is no processing process, the sheet skew feeding is corrected by the skew feeding correcting portion so that the other side (herein the long side) forming the sheet corner is parallel to the image. Specifically, whether the skew feeding correction is performed (based on the side on the sheet leading edge side) without using the skew feeding regulation amount δ is performed for each printing job or the skew feeding correction is performed (based on the side parallel to the sheet conveying direction) using the skew feeding regulation amount δ is automatically determined in the image forming apparatus. Consequently, the burden on a user can be reduced. Hereinafter, this will be described in detail.

Figure 6:
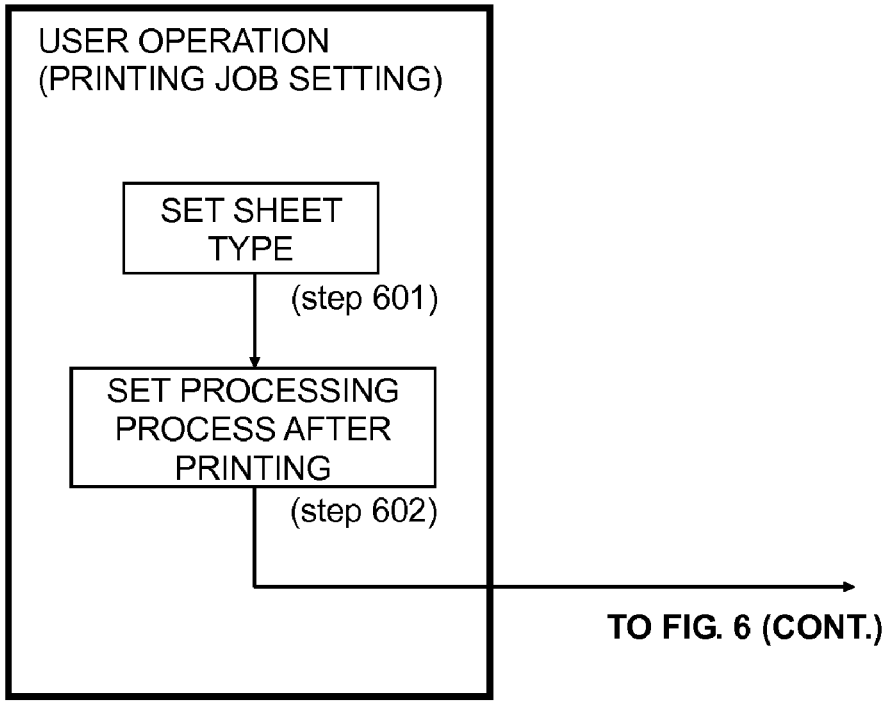
FIG. 6 is a flow chart of an image forming operation according to the first embodiment.
Figure 6:
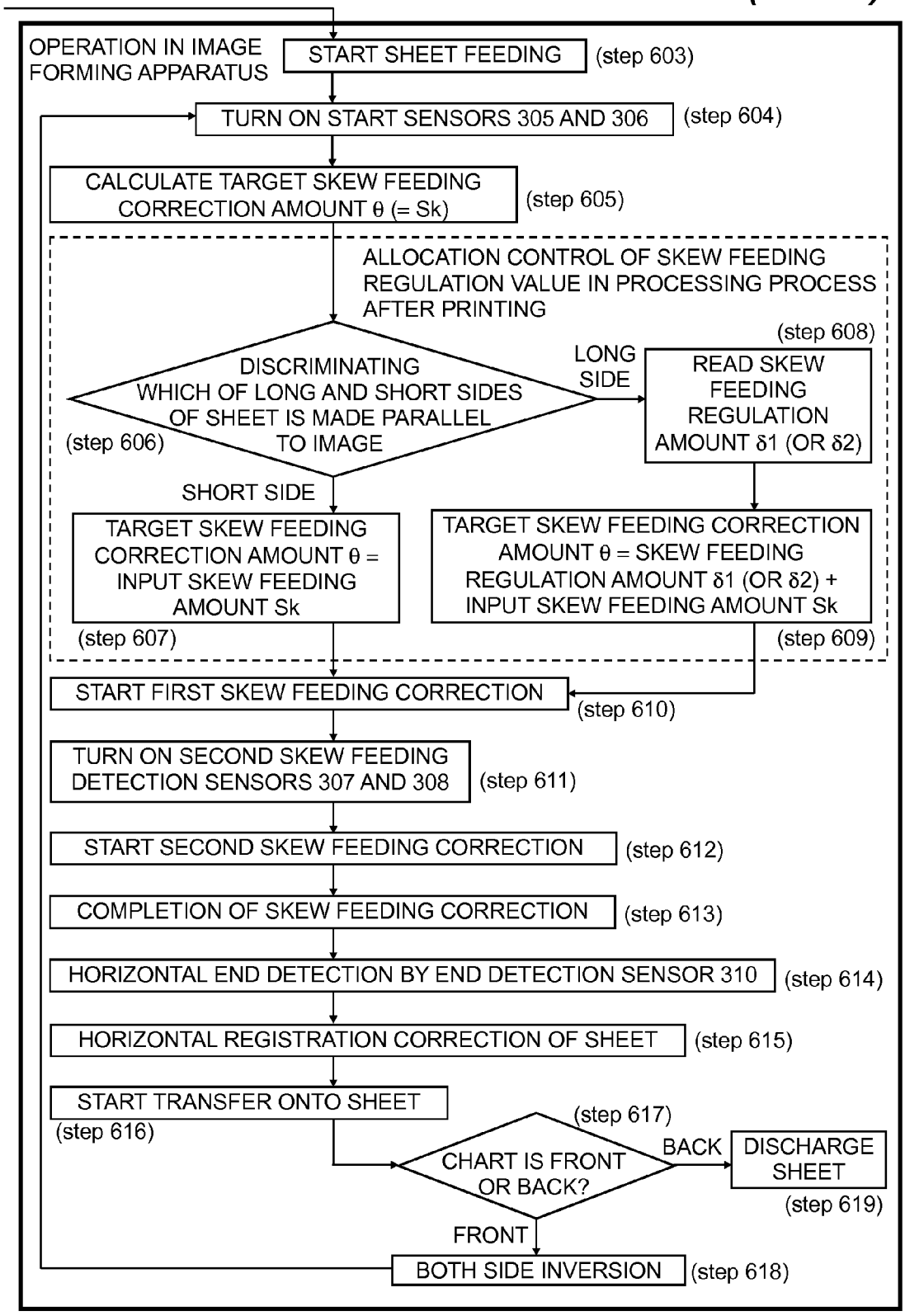

Reflection of the measurement result of the right angle degree by the end detection sensor 310 on the printing job will be described. FIG. 6 is a flow chart in which the image forming apparatus automatically selects reflection/non-reflection of the skew feeding regulation amount δ according to the printing job selected by a user.

As illustrated in FIG. 6, when setting of the sheet type (step 601) and setting of the processing process after printing (step 602) are performed by a user, feeding of a sheet is started in the image forming apparatus (step 603). The sheet leading edge conveyed to the registration portion is detected by the start sensors 305 and 306 (step 604). Then, the skew feeding correction motors 303 and 304 are started respectively based on the start sensors 305 and 306, and the skew feeding correction roller pairs 31*a* and 31*b* with the released roller nip portions are rotated to convey the sheet. The skew feeding amount Sk of the sheet leading edge is calculated from the detection time difference in the start sensors 305 and 306 (step 605).

In this case, whether the long side of the sheet is made parallel to the transferred image or the short side is made parallel to the transferred image is automatically discriminated from the information of the printing job set by the user (step 606). When it is determined from the setting information that there is no processing process in the sheet processing apparatus after printing in the image forming apparatus, the skew feeding correction is performed so that the sheet long side is made parallel to the transferred image. In this case (step 608), the skew feeding regulation amount δ1 of the sheet front surface registered in the memory 42 is added to calculate the target skew feeding correction amount θ as $\theta=Sk+\delta 1$ (step 609), and the first skew feeding correction is performed (step 610). When skew feeding is not completely corrected, the sheet skew feeding amount is detected by the downstream second skew feeding detection sensors 307 and 308 (step 611), and the second skew feeding correction is performed (step 612). In the second skew feeding correction, the sheet skew feeding amount is detected by the sensors 307 and 308 with reference to the sheet leading edge position when the skew feeding is corrected by the target skew feeding correction amount θ in the first skew feeding correction.

When it is determined, from the information of the printing job set by the user, that the processing process is performed in the sheet processing apparatus after printing in the image forming apparatus, the skew feeding correction is performed so that the sheet short side is made parallel to a transferred image. In this case (step 607), the target skew feeding correction amount θ is calculated to be θ=Sk without adding the skew feeding regulation amount δ1 of the sheet front surface stored in the memory 42 (step 607), and the first skew feeding correction is performed (step 610). When the skew feeding is not completely corrected, the sheet skew feeding amount is detected by the downstream second skew feeding detection sensors 307 and 308 (step 611), and the second skew feeding correction is performed (step 612).

After completion of the sheet skew feeding correction (step 613), the sheet horizontal end position is detected by the end detection sensor 310 (step 614), and the sheet horizontal end position is corrected by the registration roller pair 30 based on the detection information (step 615). Namely, the sheet is moved in the direction perpendicular to the sheet conveying direction by the registration roller pair 30. Thereafter, an image is transferred onto the sheet (step 616).

Thereafter, when the transferred surface of the sheet is the front surface (step 617), the inversion operation (step 618) of inverting the front and back surfaces of the sheet is performed. After the inversion operation, the skew feeding correction is performed again in steps 604 to 613. At that time, when the processing process is performed after printing, the skew feeding regulation amount δ2 of the sheet back surface registered in the memory 42 is added to calculate the target skew feeding correction amount θ as θ=Sk+δ2, and the skew feeding correction is performed. When there is no processing process after printing, the control described above is performed, and therefore the description will not be repeated. After the skew feeding correction operation, the sheet is subjected to the horizontal end position correction and then discharged outside the image forming apparatus from the discharge opening or discharged to the sheet processing apparatus (step 619).

As described above, whether the skew feeding regulation amount δ obtained by outputting the sample chart image is used is automatically discriminated according to the presence of the processing process after printing, and the skew feeding correction amount θ is automatically regulated. Consequently, the trouble for a user to manage a job and the skew feeding regulation amount can be reduced.

The sheet end detection sensor is arranged obliquely to the sheet conveying direction, and the sheet right angle degree is measured, whereby the trouble for a user to calculate the skew feeding amount regulation value can be saved. Further, a user is not required to manage the two kinds of the skew feeding regulation amounts δ for each printing job, so that the burden on the user can be reduced.

In the present embodiment, there has been described the example in which whether the skew feeding regulation amount δ is used is automatically determined according to the presence of the processing process after printing; however, whether the automatically calculated skew feeding regulation amount δ is used may be manually determined by user operation.

Second Embodiment

In the first embodiment, the end detection sensor 310 is provided on the downstream in the sheet conveying direction of skew feeding correction roller pairs 31*a* and 31*b*. In the image forming apparatus, the right angle degree information is stored in the memory 42, which stores the information for each sheet type, by the sample output operation by a user, and the skew feeding regulation amount δ is automatically determined based on the right angel degree information.

Figure 12:
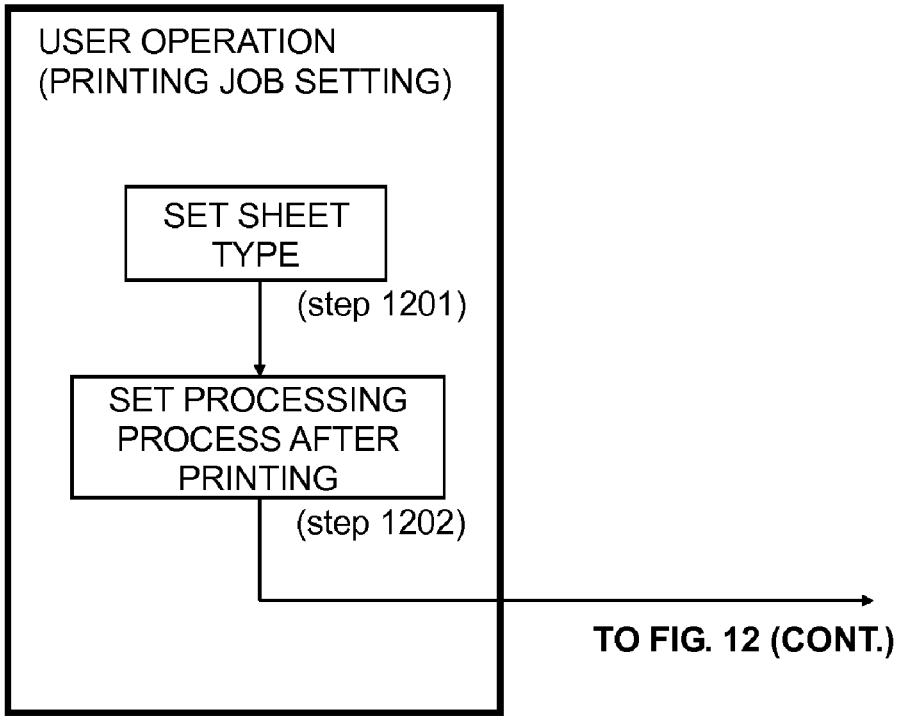
FIG. 12 is a flow chart of the image forming operation according to the second embodiment.
Figure 12:
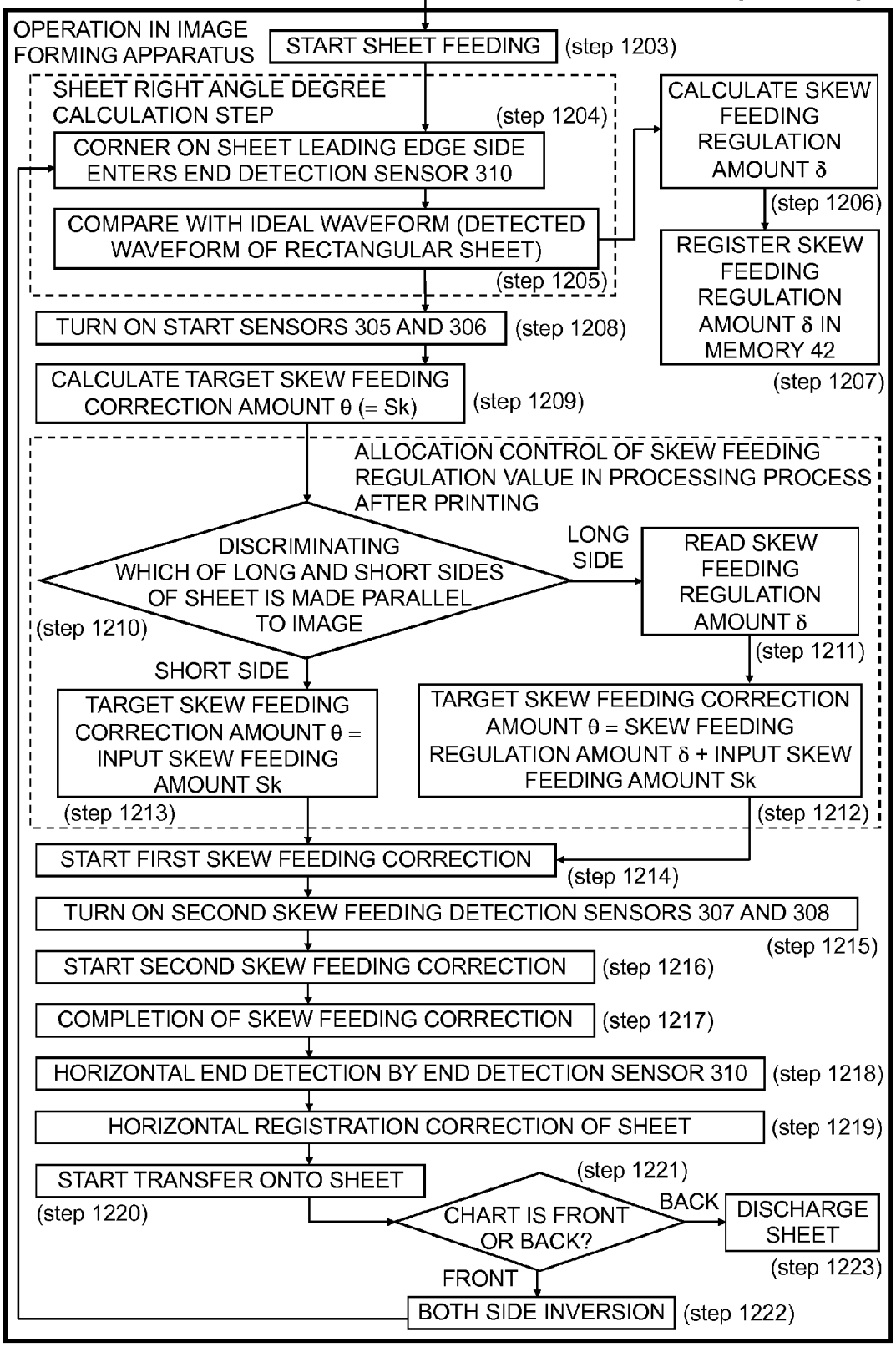

Meanwhile, in the present embodiment, the end detection sensor 310 is provided upstream in the sheet conveying direction from start sensors 305 and 306 that perform the skew feeding amount detection in the skew feeding correction and arranged to be inclined by 45° with respect to the sheet conveying direction. According to this constitution, the burden on a user can be further reduced compared with the first embodiment. Hereinafter, this constitution will be described using FIGS. 10 to 12.

A constitution of a registration portion 21 of the present embodiment will be first described.

Figure 10:
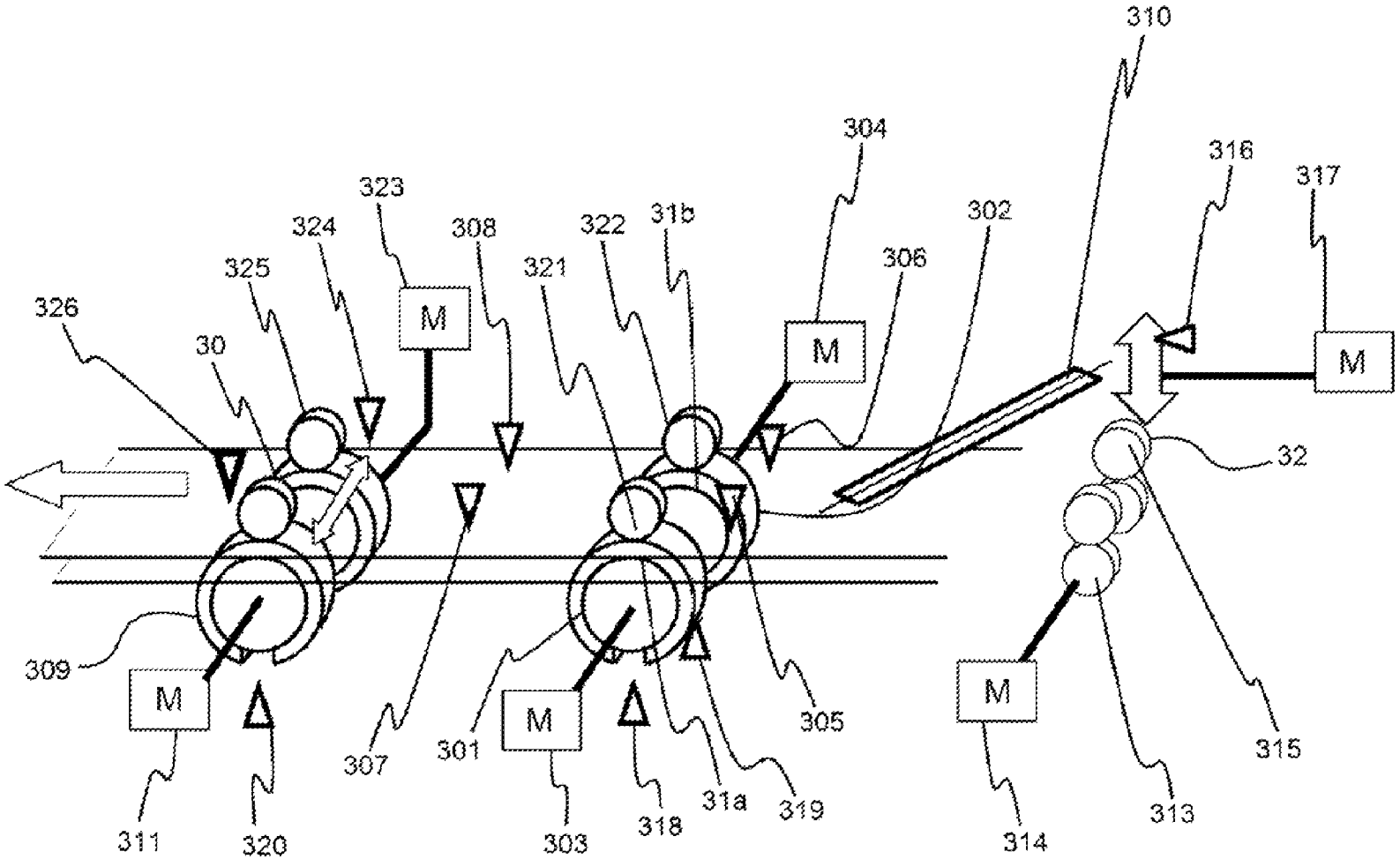
FIG. 10 is a schematic perspective view of a registration portion according to a second embodiment.
Figure 11A:
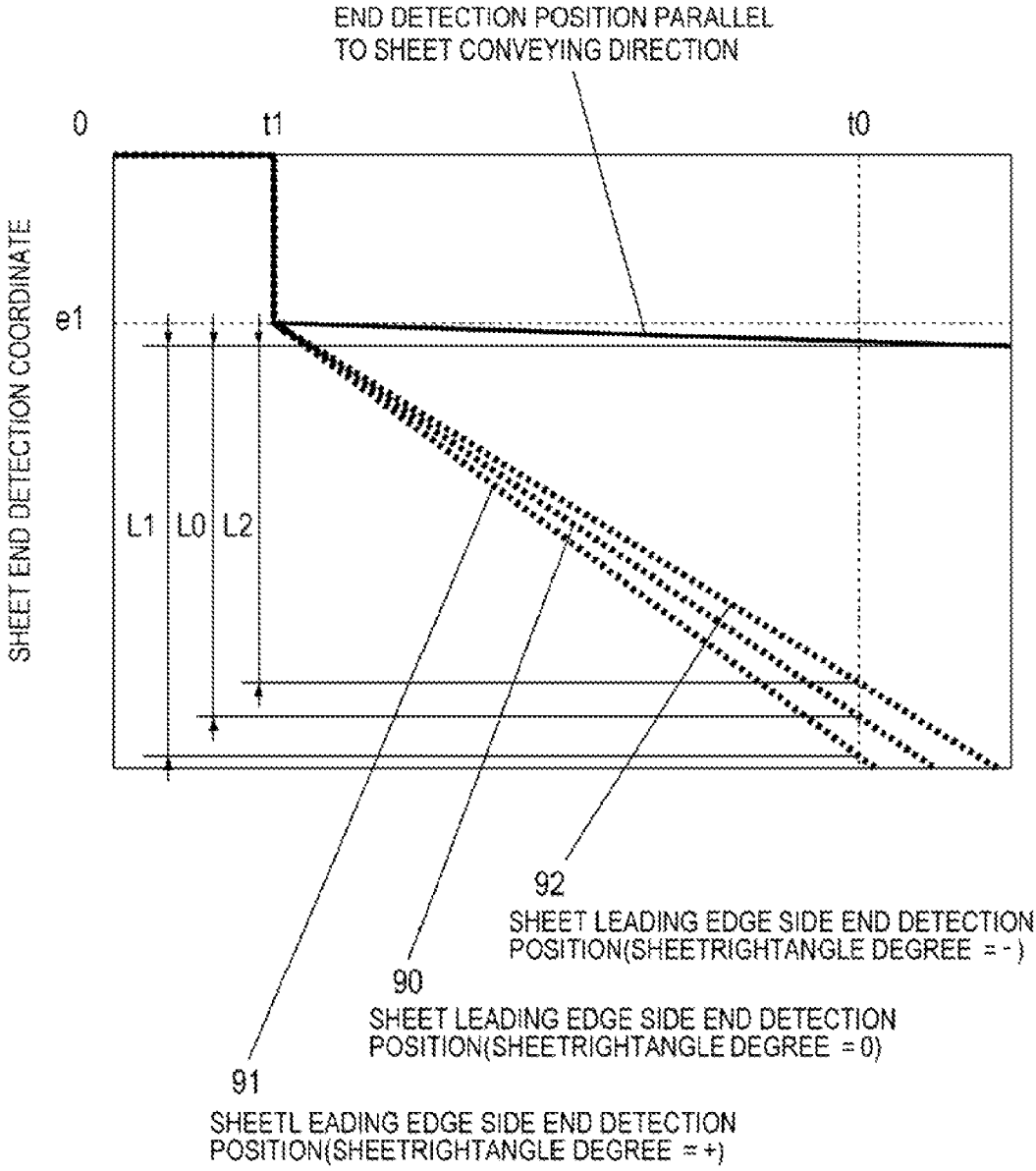
FIGS. 11A to 11D are views illustrating the detection waveforms of a sheet detected by an end detection sensor according to the second embodiment.
Figure 11B:
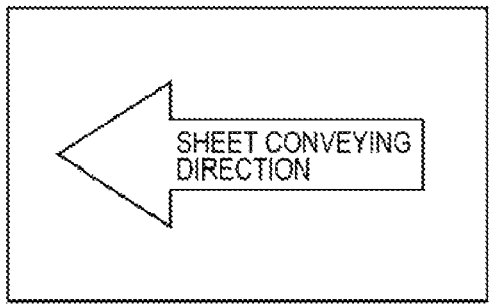
Figure 11C:
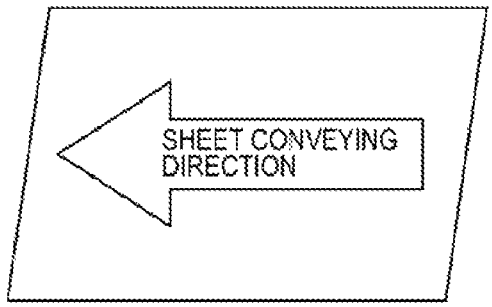
Figure 11D:
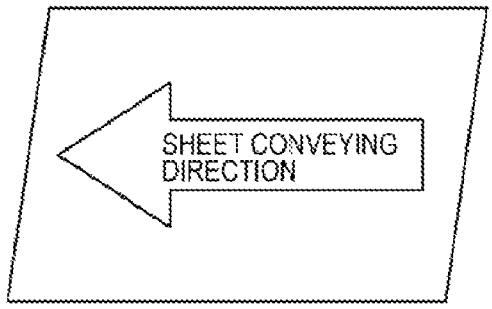

FIG. 10 is a schematic view of the constitution of the registration portion 21 according to the present embodiment. In the first embodiment, the end detection sensor 310 is provided on the downstream in the sheet conveying direction of a skew feeding correction roller pair. Meanwhile, in the present embodiment, the end detection sensor 310 is provided on the upstream in the sheet conveying direction of the skew feeding correction roller pair.

As illustrated in FIG. 10, by arranging the end detection sensor 310 on the upstream in the sheet conveying direction of the skew feeding correction roller pairs 31*a* and 31*b*, the sheet right angle degree Ld can be measured before the sheet skew feeding correction operation. Accordingly, the skew feeding regulation amount δ can be measured once per sheet conveyed to the registration portion 21. As long as a sheet to be conveyed to the registration portion 21 is used, the skew feeding regulation amount δ can be measured regardless of the first and second surfaces of the sheet. Accordingly, a user is not required to perform the skew feeding amount regulation for aligning the positions of the front and back surface images. Further, even when the sheet cutting lot is changed and the sheet right angle degree is changed, a user is not required to manage the right angle degree information for each lot. Accordingly, the burden on a user associated with the skew feeding amount regulation can be further reduced.

Hereinafter, the measurement of the skew feeding regulation amount δ according to the present embodiment will be described in detail.

FIG. 11 illustrates a detected waveform of an end on the sheet leading edge side that is detected by the end detection sensor 310. The right angle degrees are different in each of sheets 91 to 92. The sheet 91 shows a case in which the right angle degree is positive (+), the sheet 90 shows a case in which the right angle degree is 0, and the sheet 92 shows a case in which the right angle degree is negative (−). The respective detected waveforms of the sheets in the interval between times t1 and t0 are L1, L0, and L2. Accordingly, the respective sheet detection areas detected in the interval between times t1 and t0 are L1, L0, and L2 according to the sheet right angle degree.

According to the above constitution, when a case in which the sheet right angle degree is different in a + direction (the sheet corner is obtuse-angled) is represented by d1 and a case in which the sheet right angle degree is different in a − direction (the sheet corner is acute-angled) is represented by d2, the skew feeding regulation amount can be measured as d1=L0−L1 and d2=L0−L2.

By using a distance L in the direction perpendicular to the sheet conveying direction between the sensors 305 and 306 as first sheet skew feeding detecting portions and between sensors 307 and 308 as second sheet skew feeding detecting portions and a sheet conveying speed V, the skew feeding regulation amount δ can be represented by δ=Ld/V (t0−t1). The skew feeding regulation amount δ is automatically calculated by the above formula.

The skew feeding regulation amount δ automatically calculated as above is added to the input skew feeding amount Sk in the skew feeding correction operation to be described below and is set as the target skew feeding correction amount θ=Sk+δ.

Hereinafter, the operation of the image forming apparatus in the present embodiment will be described.

When setting of the sheet type (step 1201) and setting of the processing process after printing (step 1202) are performed by user operation, feeding of a sheet is started in the image forming apparatus (step 1203). When the sheet leading edge conveyed to the registration portion 21 is conveyed by a pre-registration roller pair 32, then upon entering of the corner on the sheet leading edge side into the end detection sensor 310 (step 1204), the right angle degree Ld of the corner on the sheet leading edge side is measured. The sheet skew feeding regulation amount δ is calculated (step 1206) by comparing time-series end position detection data of the end detection sensor 310 with ideal waveform data (the end position detection data obtained when the sheet in which the right angle degree is 0 is conveyed) (step 1205). At the same time, the information of the calculated sheet skew feeding regulation amount δ is temporarily stored in the memory 42 (step 1207).

Thereafter, the sheet leading edge conveyed by the pre-registration roller pair 32 is detected by the start sensors 305 and 306 (step 1208). Then, skew feeding correction motors 303 and 304 are started respectively based on the start sensors 305 and 306, and the skew feeding correction roller pairs 31*a* and 31*b* with the released roller nip portions are rotated to convey the sheet. The input skew feeding amount Sk of the sheet leading edge is calculated from the detection time difference in the start sensors 305 and 306 (step 1209).

Whether the long side of the sheet is made parallel to a transferred image or the short side is made parallel to the transferred image is automatically discriminated from the information of the printing job set by a user (step 1210). When it is determined that there is no processing process in the sheet processing apparatus after printing in the image forming apparatus, the skew feeding correction is performed so that the sheet long side is made parallel to the transferred image. In this case (step 1211), the sheet skew feeding regulation amount δ registered in the memory 42 is added to calculate the target skew feeding correction amount θ as θ=Sk+δ (step 1212), and the first skew feeding correction is performed (step 1214). When skew feeding is not completely corrected, the sheet skew feeding amount is detected by the downstream second skew feeding detection sensors 307 and 308 (step 1215), and the second skew feeding correction is performed (step 1216). In the second skew feeding correction, the sheet skew feeding amount is detected by the sensors 307 and 308 with reference to the sheet leading edge position when the skew feeding is corrected by the target skew feeding correction amount θ in the first skew feeding correction.

When it is determined from the information of the printing job set by the user that the processing process is performed in the sheet processing apparatus after printing in the image forming apparatus, the skew feeding correction is performed so that the sheet short side is made parallel to the transferred image. In this case, the target skew feeding correction amount θ as θ=Sk without adding the sheet skew feeding regulation amount δ stored in the memory 42 (step 1213), and the first skew feeding correction is performed (step 1214). When the skew feeding is not completely corrected, the sheet skew feeding amount is detected by the downstream second skew feeding detection sensors 307 and 308 (step 1215), and the second skew feeding correction is performed (step 1216).

After completion of the skew feeding correction operation of a sheet (step 1217), the horizontal end position correction (steps 1218 and 1219) and the image transfer onto a sheet (step 1220) are performed as in the first embodiment. Thereafter, when the sheet transferred surface is the front surface (step 1221), the inversion operation of inverting the sheet front and back surfaces is performed (step 1222). After the inversion operation, the detection of the skew feeding regulation amount δ and the skew feeding correction operation are applied to the sheet back surface on in the sheet front surface, and therefore, the description here will not be repeated. After completion of the image transfer onto the sheet back surface, the sheet is discharged outside the image forming apparatus (step 1223), and the printing job is completed.

As described above, the skew feeding regulation amount δ can be measured each time for each sheet passing through the registration portion 21 regardless of the sheet front and back surfaces. Consequently, the skew feeding amount regulation operation for the positional alignment between the front and back surface images by a user can be further reduced compared with the first embodiment. Further, when the sheet cutting lot is changed and the sheet right angle degree is changed, a user is not required to manage the right angle degree information for each lot, and therefore, the burden on a user associated with the skew feeding amount regulation can be reduced.

Even if the sheet cutting lot is the same, the cutting accuracy may be varied according to a difference of a cutting blade and the number of sheets cut in a single cutting, so that the right angle degree of the sheet corner is varied. However, according to the present embodiment, a single right angle degree measurement is applied to one surface of a sheet, and therefore, even if the right angle degree is varied in the same lot, the correction can be performed. Accordingly, the skew feeding correction accuracy can be improved.

Another Embodiment

In the above embodiments, although the controller of the image forming apparatus is exemplified as the controlling portion, the controlling portion is not limited thereto. For example, a sheet conveying apparatus having a registration portion which corrects the sheet skew feeding may have the controller. In this case, the sheet conveying apparatus may be configured to be integral with the image forming apparatus or may be configured to be detachably attachable to the image forming apparatus. The image forming apparatus and the sheet conveying apparatus may have different controlling portions, and the respective controlling portions may be connected to each other to perform the control operation.

In the above embodiments, although the case in which the sheet is conveyed so that the short side is the leading edge is exemplified and described, the present invention is not limited to this case, and the present invention is effective even when the sheet is conveyed so that the long side is the leading edge.

In the above embodiments, although the printer is exemplified as the image forming apparatus, the present invention is not limited thereto. For example, there may be employed other image forming apparatus such as a copier and a facsimile machine or other image forming apparatus such as a complex machine having a combination of the functions of the a copying machine, a facsimile apparatus, and so on. Alternatively, there may be employed an image forming apparatus in which a recording material carrier is used and toner images of respective colors are sequentially superimposed and transferred onto a recording material (sheet) carried by the recoding material carrier. Alternatively, there may be employed an image forming apparatus in which an intermediate transfer member is used, toner images of respective colors are sequentially superimposed and transferred onto the intermediate transfer member, and the toner images carried by the intermediate transfer member are collectively transferred onto a recording material (sheet). A similar effect can be obtained by applying the present invention to the sheet conveying apparatus used in those image forming apparatuses.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2010-251407, filed Nov. 10, 2010, which is hereby incorporated by reference herein in its entirety.

What is claimed is:

1. A sheet conveying apparatus, which conveys a sheet toward an image forming portion forming an image on a sheet, comprising:

a skew feeding correcting portion which corrects skew feeding of the sheet;

a sheet end detecting portion which detects a corner on the conveying direction leading edge side of the sheet being conveyed and two sides forming the corner and detects a right angle degree of the corner; and a controlling portion which automatically calculates, based on the sheet right angle degree detected by the sheet end detecting portion, a skew feeding regulation amount used for making any one of the two sides forming the corner of the sheet, parallel to the image to be formed on the sheet by the image forming portion and controls the skew feeding correcting portion so as to correct the skew feeding of the sheet based on the skew feeding regulation amount so that any one of the two sides forming the corner of the sheet is parallel to the image.

2. The sheet conveying apparatus according to claim 1, wherein the sheet end detecting portion is provided on the downstream in the conveying direction of the skew feeding correcting portion and detects the right angle degree of a sheet whose skew feeding is corrected by the skew feeding correcting portion.

3. The sheet conveying apparatus according to claim 1, wherein the sheet end detecting portion is provided on the upstream in the conveying direction of the skew feeding correcting portion and detects the sheet right angle degree before the skew feeding is corrected by the skew feeding correcting portion.

4. The sheet conveying apparatus according to claim 1, wherein the skew feeding correcting portion includes:

a first skew feeding detecting portion which detects the skew feeding of the sheet;

a second skew feeding detecting portion which is provided downstream of the first skew feeding detecting portion and detects the skew feeding of the sheet; and a skew feeding correcting portion which corrects the skew feeding of the sheet by swiveling the sheet while conveying the sheet, and the skew feeding correcting portion applies first skew feeding correction to the sheet based on the detection by the first skew feeding detecting portion and subsequently, after the first skew feeding correction, applies second skew feeding correction to the sheet based on the detection by the second skew feeding detecting portion.

5. An image forming apparatus comprising:

an image forming portion which forms an image on a sheet; and a sheet conveying apparatus which conveys the sheet toward the image forming portion, the sheet conveying apparatus includes:

a skew feeding correcting portion which corrects skew feeding of the sheet;

a sheet end detecting portion which detects a corner on the conveying direction leading edge side of a sheet being conveyed and two sides forming the corner and detects a right angle degree of the corner, a controlling portion which automatically calculates based on the sheet right angle degree detected by the sheet end detecting portion, a skew feeding regulation amount used for making any one of the two sides, forming the corner of the sheet, parallel to the image to be formed on the sheet by the image forming portion and controls the skew feeding correcting portion so as to correct the skew feeding of the sheet based on the skew feeding regulation amount so that any one of the two sides forming the corner of the sheet is parallel to the image.

6. The image forming apparatus according to claim 5, wherein the sheet end detecting portion is provided on the downstream in the conveying direction of the skew feeding correcting portion and detects the right angle degree of a sheet whose skew feeding is corrected by the skew feeding correcting portion.

7. The image forming apparatus according to claim 5, wherein the sheet end detecting portion is provided on the upstream side in the conveying direction of the skew feeding correcting portion and detects the sheet right angle degree before the skew feeding is corrected by the skew feeding correcting portion.

8. The image forming apparatus according to claim 5, wherein the skew feeding correcting portion includes:

a first skew feeding detecting portion which detects the skew feeding of the sheet;

a second skew feeding detecting portion which is provided downstream of the first skew feeding detecting portion and detects the skew feeding of the sheet; and a skew feeding correcting portion which corrects the skew feeding of the sheet by swiveling the sheet while conveying the sheet, and the skew feeding correcting portion applies first skew feeding correction to the sheet based on the detection by the first skew feeding detecting portion and subsequently, after the first skew feeding correction, applies second skew feeding correction to the sheet based on the detection by the second skew feeding detecting portion.

9. The image forming apparatus according to claim 5, wherein a sheet processing apparatus which applies processing to the sheet formed with the image is detachably attachable to the image forming apparatus, and the controlling portion corrects the skew feeding of the sheet by the skew feeding correcting portion so that when a processing process is performed by the sheet processing apparatus, a side on the conveying direction leading edge side that is one side forming the corner of the sheet is parallel to the image, and when there is no processing process, the other side forming the corner of the sheet is parallel to the image.

* * * * *